US007891661B2

(12) United States Patent
Obuchi

(10) Patent No.: US 7,891,661 B2
(45) Date of Patent: Feb. 22, 2011

(54) SHEET STACKING DEVICE AND IMAGE FORMING APPARATUS

(75) Inventor: Yusuke Obuchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 12/270,730

(22) Filed: Nov. 13, 2008

(65) Prior Publication Data

US 2009/0127771 A1 May 21, 2009

(30) Foreign Application Priority Data

Nov. 15, 2007 (JP) ..... 2007-296446
Feb. 28, 2008 (JP) ..... 2008-047143

(51) Int. Cl.
*B65H 31/04* (2006.01)

(52) U.S. Cl. ..... 271/217; 271/214; 271/215; 399/405

(58) Field of Classification Search ..... 271/213, 271/214, 215, 217, 219; 399/405
See application file for complete search history.

(56) References Cited

U.S. PATENT DOCUMENTS 7,226,050 B2 * 6/2007 Sekiyama et al. ..... 271/213
2006/0018692 A1 * 1/2006 Kubo ..... 399/405
2006/0193668 A1 * 8/2006 Akiyama et al. ..... 399/405

FOREIGN PATENT DOCUMENTS

JP 8-26570 1/1996
JP 2001-348162 12/2001
JP 2006219286 A * 8/2006
JP 2007112581 A * 5/2007
JP 2009044449 A * 2/2009

* cited by examiner

*Primary Examiner*—Kaitlin S Joerger
(74) *Attorney, Agent, or Firm*—Canon USA Inc IP Div

(57) ABSTRACT

A sheet stacking device includes a liftable/lowerable sheet stacking portion on which sheets to be ejected are stackable. The sheet stacking portion moves downward as an amount of stacked sheets increases. The sheet stacking device includes a movable member disposed below the sheet stacking portion with a space therebetween, and a detecting portion configured to output a signal in accordance with a position of the movable member. Ejection of the sheet to the sheet stacking portion is stopped on the basis of the signal output from the detecting portion in accordance with downward movement of the movable member.

26 Claims, 16 Drawing Sheets

SHEET STACKING DEVICE AND IMAGE FORMING APPARATUS

BACKGROUND OF THE INVENTION

1. Field of the Invention

The present invention relates to sheet stacking devices and image forming apparatuses.

2. Description of the Related Art

A known example of a sheet stacking device is a device which stacks sheets that are ejected after images are formed thereon.

In order to stack a larger number of sheets on a stacker tray of a sheet stacking device, it is necessary for the stacker tray to have a large driving range in the vertical direction. For this reason, the driving range within which the stacker tray moves must not have any obstacles and must therefore always provide an empty space for the stacker tray to move therein.

However, users that desire to utilize small spaces efficiently tend to consider the space below the stacker tray to be a dead space. In consequence, this space below the stacker tray is commonly used as a space for placing supplies such as sheets and toners for an image forming apparatus or as a space for placing office supplies such as trash bins.

As sheets are sequentially stacked onto the stacker tray to cause the stacker tray to descend, an object such as a stack of sheets placed below the stacker tray in the above-described manner become an obstacle and unfavorably prevents the stacker tray from descending further. This causes an error or failure in the apparatus. Therefore, when stacking a large number of sheets, the user needs to check whether there is an object placed below the stacker tray.

Japanese Patent Laid-Open No. 8-26570 discloses a technology in which an optical sensor is used to detect whether or not there is an object acting as an obstacle placed below the stacker tray.

FIG. 15 illustrates a sheet stacking device of related art that is equipped with such an optical sensor. A sheet stacking device C is provided in a sheet processing apparatus B and includes a catch tray 12, serving as an example of a sheet stacking portion, which is movable vertically so that ejected sheets from an image-forming-apparatus main body A can be stacked on the tray 12. A reflective optical sensor 1101 is provided at a lower section of the catch tray 12 and is configured to detect an object 1102.

Japanese Patent Laid-Open No. 2001-348162 discloses a technology in which a switch is used to detect whether or not there is an object acting as an obstacle placed below the stacker tray.

FIG. 16 illustrates another sheet stacking device of related art that is equipped with such a switch. This sheet stacking device includes a stacker tray 13 serving as an example of a sheet stacking portion that is vertically movable in accordance with the number of ejected and stacked sheets. The stacker tray 13 includes a stationary member 2 fixed to the undersurface of the stacker tray 13 and a damper member 3 set rotatably with respect to the stationary member 2 and biased in a direction away from the stationary member 2.

The stationary member 2 is equipped with a switch 41 that detects whether the damper member 3 is within a predetermined distance. In FIG. 16, reference numeral 1102 denotes an object acting as an obstacle placed below the stacker tray 13.

As the number of stacked sheets increases to cause the stacker tray 13 to descend, the damper member 3 eventually comes into contact with the object 1102. In this case, if the stacker tray 13 descends even further, a projection 31 provided on the damper member 3 fits into a recess in the switch 41 so as to turn on the switch 41, whereby it can be detected that the object 1102 is below the stacker tray 13.

However, the sheet stacking devices and image forming apparatuses of the related art described above may have problems. For example, with a sheet stacking device that is configured to detect an object with a reflective optical sensor as shown in FIG. 15, the detectability of an object is affected by the reflectivity or the color of the object or by the operating environment. Furthermore, since a reflective optical sensor has a limited detection range, multiple optical sensors are required in order to detect the entire area below the catch tray. This can lead to complicated object-detection control in addition to an increase in power consumption and cost.

On the other hand, in a sheet stacking device that is configured to detect an object with a switch 41 as shown in FIG. 16, an object can be detected using a single switch 41. However, with the configuration in which an object is detectable with the switch 41 shown in FIG. 16, the stacker tray 13 that moves vertically relative to the apparatus main body has the object-detecting damper member attached thereto in a rotatable fashion, causing the vertically movable stacker tray 13 to have a complex structure. The reason this complex structure is inevitable is that, in order to make the entire area below the stacker tray 13 into a detectable range, the damper member needs to be rotatably attached to the vertically movable stacker tray 13 so as to cover the entire undersurface of the stacker tray 13.

Moreover, with the configuration in which an object is detectable with the switch 41 shown in FIG. 16, the presence of an object can be detected only after the stacker tray 13 (i.e., the damper member 3) comes into contact with the object. Therefore, when the switch 41 detects the object 1102, even though the stacker tray 13 can be stopped from descending further, it is difficult to stop the operation of the image-forming-apparatus main body immediately, thus undesirably causing the image forming operation to continue. There may also be a case where pre-stacked sheets still remain inside the sheet stacking device. Therefore, after stopping the stacker tray 13, the sheets remaining inside the image-forming-apparatus main body and the sheet stacking device must all be ejected onto the stacker tray 13.

However, when ejecting and stacking these sheets onto the stacker tray 13, the usual sheet stacking control operation where the stacker tray 13 is lowered in accordance with the ejection of sheets cannot be performed, thus resulting in reduced stackability of sheets on the stacker tray 13.

SUMMARY OF THE INVENTION

The present invention provides a sheet stacking device and an image forming apparatus that allow sheets to be stacked onto a sheet stacking portion in a state where an object is assuredly removed from below a sheet stacking portion.

According to an aspect of the present invention, a sheet stacking device includes a liftable/lowerable sheet stacking portion on which sheets to be ejected are stackable. The sheet stacking portion moves downward as an amount of stacked sheets increases. The sheet stacking device includes a movable member disposed below the sheet stacking portion with a space therebetween, and a detecting portion configured to output a signal in accordance with a position of the movable member. Ejection of the sheet to the sheet stacking portion is stopped on the basis of the signal output from the detecting portion in accordance with downward movement of the movable member.

In the present invention, since the ejection of the sheets is stopped in accordance with the downward movement of the movable member provided below the sheet stacking portion with a space therebetween, a foreign object (obstacle) below the sheet stacking portion can be detected with a simple configuration.

Further features of the present invention will become apparent from the following description of exemplary embodiments with reference to the attached drawings.

DESCRIPTION OF THE EMBODIMENTS

Exemplary embodiments of the present invention will be described below with reference to the drawings.

Figure 1:
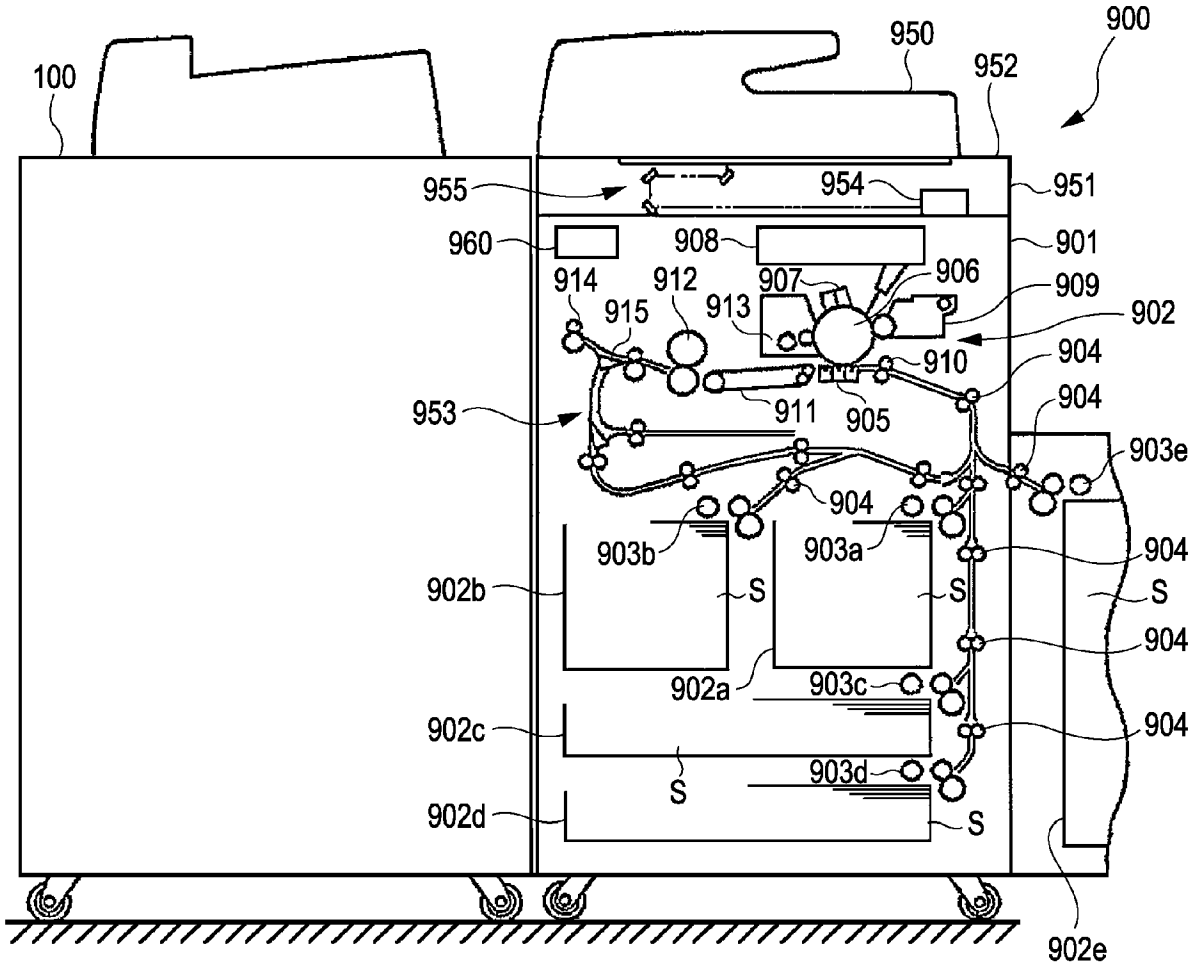
FIG. 1 illustrates an image forming apparatus equipped with a sheet stacking device according to a first exemplary embodiment of the present invention.

FIG. 1 illustrates an image forming apparatus equipped with a sheet stacking device according to a first exemplary embodiment of the present invention.

In FIG. 1, reference numeral 900 denotes an image forming apparatus, and 901 denotes an image-forming-apparatus main body. An upper section of the image-forming-apparatus main body 901 is provided with an image scanning device 951 that includes a scanner unit 955 and an image sensor 954. The upper surface of the image scanning device 951 is provided with a document feeding device 950 that feeds documents onto a platen glass 952.

In the midsection of the image-forming-apparatus main body 901 are provided an image forming portion 902 for forming images on sheets and a double-face reversing unit 953. The image forming portion 902 includes, for example, a cylindrical photosensitive drum 906, a charger 907, a developer 909, and a cleaning unit 913. Moreover, a fixing unit 912 and a pair of ejection rollers 914 are disposed downstream of the image forming portion 902.

The image-forming-apparatus main body 901 is connected to a stacker 100 serving as a sheet stacking device configured to stack sheets that are ejected from the image-forming-apparatus main body 901 after images are formed on the sheets. Reference numeral 960 denotes a controller that controls the image-forming-apparatus main body 901 and the stacker 100.

An image forming operation performed within the image-forming-apparatus main body 901 having the above-described configuration will now be described.

When an image formation signal is output from the controller 960, the document feeding device 950 places a document on the platen glass 952. The image scanning device 951 then scans the image of the document, and the scanned digital data is input to an exposure unit 908. The exposure unit 908 emits light toward the photosensitive drum 906 in accordance with the digital data.

At this time, the surface of the photosensitive drum 906 is uniformly charged by the charger 907, whereby an electrostatic latent image forms on the surface of the photosensitive drum 906 as the result of the emitted light. The developer 909 develops the electrostatic latent image, thereby forming a toner image on the surface of the photosensitive drum 906.

On the other hand, when a paper feed signal is output from the controller 960, a sheet S set in one of cassettes 902*a* to 902*d* or in a feeder deck 902*e* is conveyed to a registration roller 910 via a corresponding one of feeding rollers 903*a* to 903*e* and via corresponding pairs of conveying rollers 904.

The registration roller 910 then conveys the sheet S to a transferring portion equipped with a transfer-detach charger 905 at a timing such that the leading end of the sheet S becomes aligned with an end of the toner image on the photosensitive drum 906. In this transferring portion, the transfer-detach charger 905 applies transfer bias onto the sheet S so that the toner image on the photosensitive drum 906 becomes transferred to the sheet S.

Subsequently, the sheet S with the toner image transferred thereto is conveyed to the fixing unit 912 by a conveyor belt 911. As the sheet S is nipped and conveyed between a heating roller and a pressing roller of the fixing unit 912, the toner image becomes thermally fixed to the sheet S. At this time, a foreign substance such as residual toner that adhered on the photosensitive drum 906 without being transferred onto the sheet S is scraped off with a blade of the cleaning unit 913. Consequently, the surface of the photosensitive drum 906 becomes clean so that the photosensitive drum 906 can prepare for the subsequent image forming operation.

The sheet S with the fixed image is either directly conveyed to the stacker 100 by the ejection rollers 914 or conveyed to the double-face reversing unit 953 by a switching member 915 so as to undergo an image forming operation again.

Figure 2:
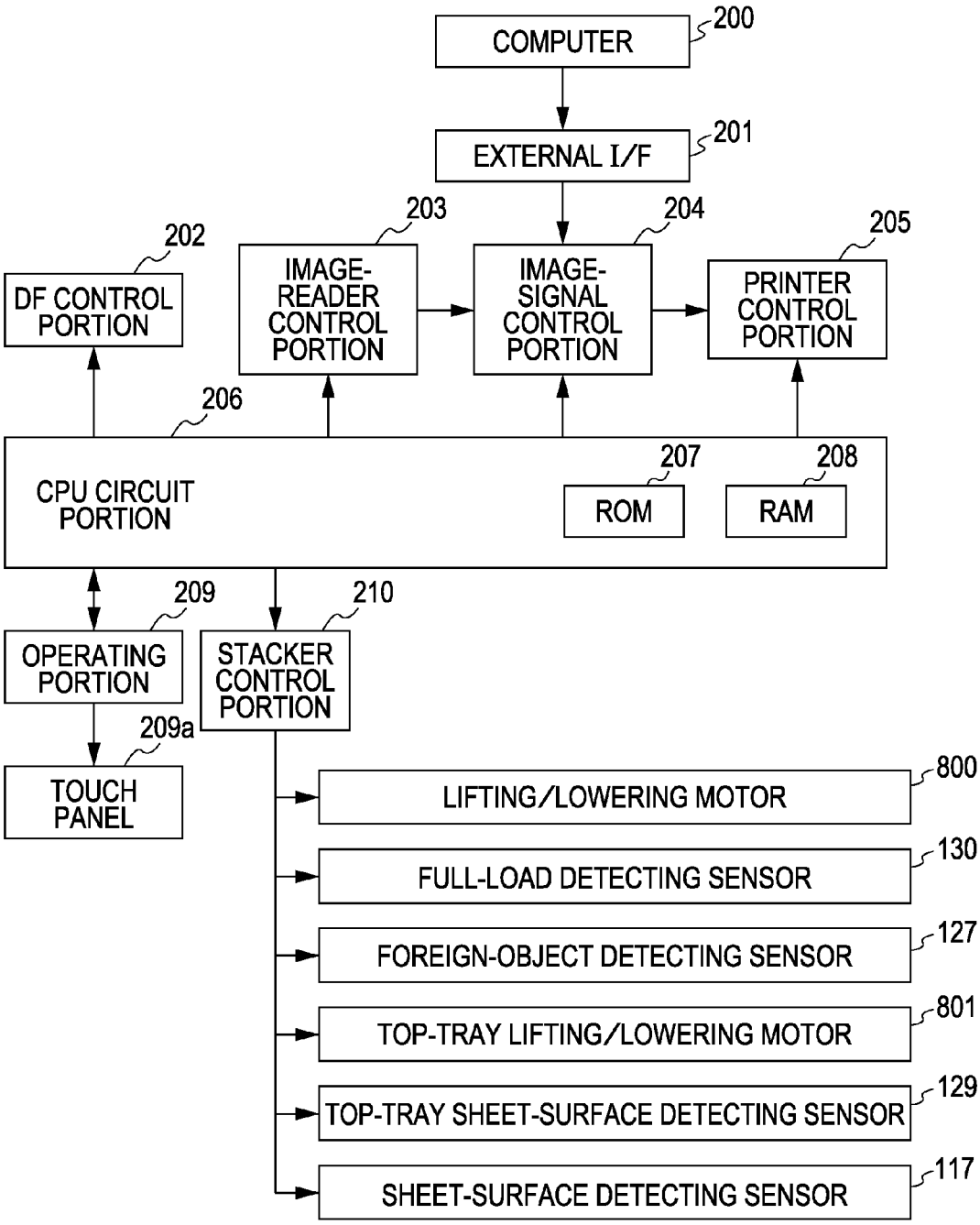
FIG. 2 is a control block diagram of a controller provided in the image forming apparatus.

FIG. 2 is a block diagram showing the configuration of the controller 960. The controller 960 includes a central-processing-unit (CPU) circuit portion 206. The CPU circuit portion 206 contains a CPU (not shown), a read-only memory (ROM) 207, and a random access memory (RAM) 208. A control program stored in the ROM 207 controls a document-feeding (DF) control portion 202, an image-reader control portion 203, an image-signal control portion 204, a printer control portion 205, a stacker control portion 210, and an operating portion 209. The RAM 208 is configured to temporarily hold control data and is also used as a work area for arithmetic processes involved in control operations.

The DF control portion 202 is configured to drive the document feeding device 950 on the basis of an instruction from the CPU circuit portion 206. The image-reader control portion 203 is configured to drive the scanner unit 955 and the image sensor 954 equipped in the image scanning device 951 and to transfer an analog image signal output from the image sensor 954 to the image-signal control portion 204.

The image-signal control portion 204 is configured to perform predetermined processes after converting the analog image signal from the image sensor 954 to a digital signal, and to convert the digital signal to a video signal before outputting the video signal to the printer control portion 205.

The image-signal control portion 204 performs various processes on a digital image signal received from a computer 200 or from the outside via an external interface (I/F) 201 and also converts the digital image signal to a video signal before outputting the video signal to the printer control portion 205. The processes performed by the image-signal control portion 204 are controlled by the CPU circuit portion 206.

The printer control portion 205 is configured to drive the exposure unit 908 via an exposure control portion (not shown) on the basis of the input video signal. The operating portion 209 includes multiple keys for setting various functions related to an image forming operation, a display portion for displaying information indicating the set modes, and a touch panel 209*a* serving as a notifying unit to be described hereinafter. A key signal is output to the CPU circuit portion 206 in response to the operation of the corresponding key, and the display portion displays corresponding information on the basis of a signal from the CPU circuit portion 206.

The stacker control portion 210 is contained in the stacker 100 and is configured to drive the entire stacker 100 by exchanging information with the CPU circuit portion 206. The stacker control portion 210 is connected to a lifting/lowering motor 800, a top-tray lifting/lowering motor 801 serving as a driving portion, a top-tray sheet-surface detecting sensor 129, a full-load detecting sensor 130, a foreign-object detecting sensor 127, a sheet-surface detecting sensor 117, and a solenoid (not shown). The control content will be described later. Alternatively, the stacker control portion 210 may be integrally incorporated in the CPU circuit portion 206 contained in the image-forming-apparatus main body 901. In that case, the stacker control portion 210 can control the stacker 100 directly from the image-forming-apparatus main body 901.

Figure 3:
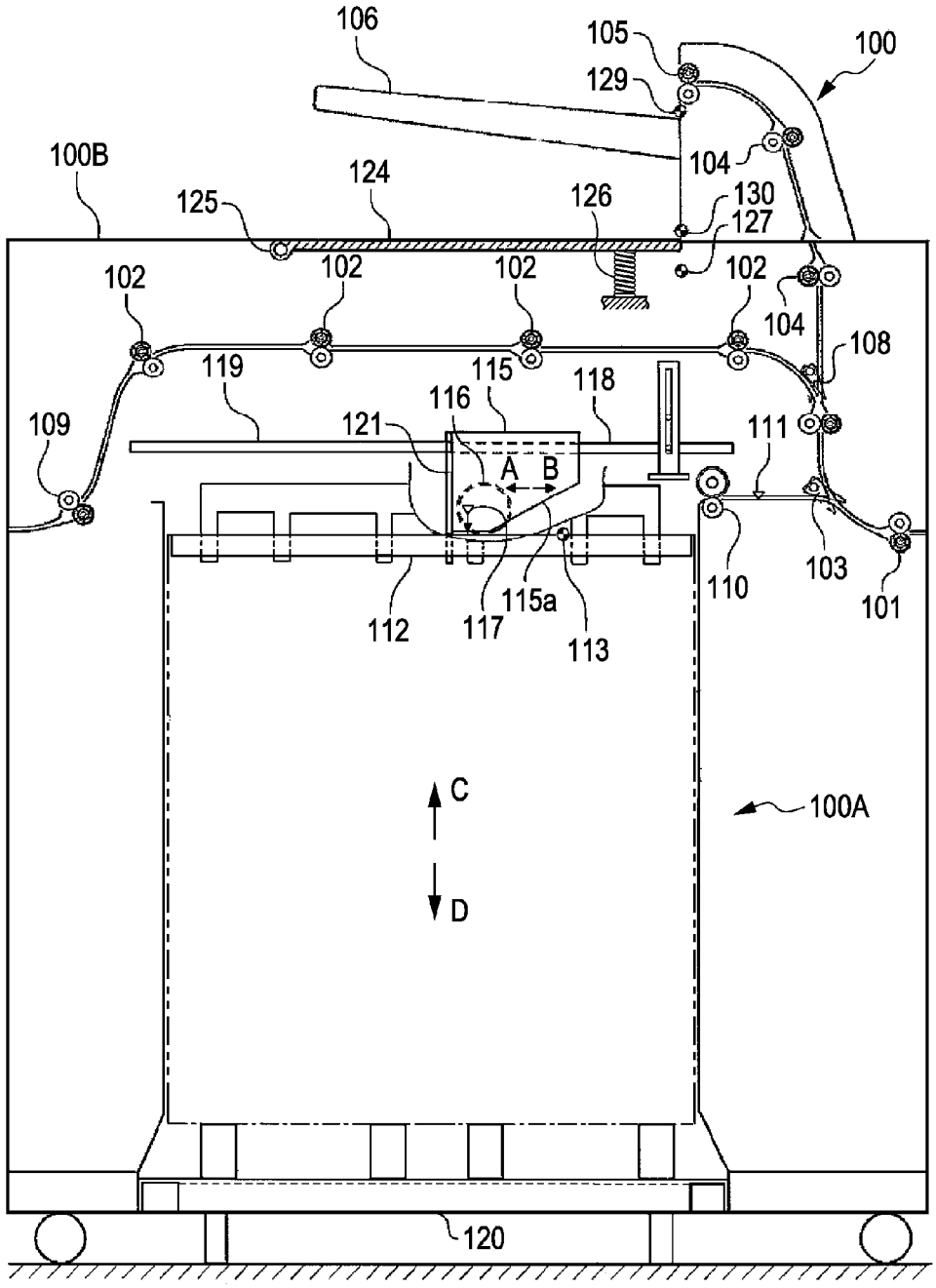
FIG. 3 illustrates a stacker.

FIG. 3 illustrates the stacker 100. The stacker 100 is equipped with a top tray 106 in a liftable/lowerable fashion above the upper surface thereof. The top tray 106 serves as a sheet stacking portion on which sheets ejected from the image-forming-apparatus main body 901 can be stacked. The top tray 106 is configured to be lowered as the number of stacked sheets increases.

The stacker 100 includes a stack portion 100A serving as a sheet stacking portion. The stack portion 100A has a stacker tray 112 serving as a sheet stacking portion for stacking sheets. The stacker tray 112 in the stack portion 100A is liftable and lowerable by the lifting/lowering motor 800 (see FIG. 2) in directions indicated by arrows C and D.

Furthermore, the stacker 100 is equipped with a first switch member 103 configured to be driven by a solenoid (not shown) to allow a sheet S conveyed into the stacker 100 to face the top tray 106 or the stack portion 100A. In FIG. 3, reference numeral 108 denotes a second switch member. In the case where the sheets are to be ejected to a sheet processing apparatus (not shown) located downstream, i.e., a stacker device, the second switch member 108 is driven by a solenoid (not shown).

Furthermore, in FIG. 3, a sheet drawing unit 115 configured to draw in a sheet ejected by a pair of ejection rollers 110 serving as a sheet ejecting unit is provided. The sheet drawing unit 115 includes a knurled belt 116 rotatable clockwise and having elasticity for drawing a sheet towards above the stacker tray, and also includes a leading-end stopper 121 for positioning the sheet in the ejection direction.

The sheet drawing unit 115 allows the knurled belt 116 to draw an ejected sheet into between the knurled belt 116 and the stacker tray 112 and subsequently allows the sheet to abut on the leading-end stopper 121. Consequently, the ejected sheet can be stacked in a state where it is positioned on the stacker tray 112.

The sheet drawing unit 115 is attached to a slide shaft 118 in a movable fashion in directions indicated by arrows A and B. By being driven by a drawing-unit driving motor (not shown), the sheet drawing unit 115 can be moved to various positions according to sheet sizes. The frame that forms the sheet drawing unit 115 has a tapered surface 115*a* for guiding a drawn-in sheet to the knurled belt 116.

The sheet-surface detecting sensor 117 is provided for maintaining a fixed distance between the sheet drawing unit 115 and the top surface of stacked sheets. A signal from the sheet-surface detecting sensor 117 is input to the stacker control portion 210 (see FIG. 2). In this embodiment, the position of the top surface of stacked sheets is set to below the pair of ejection rollers 110 so that when the stacked sheets are curled upward, the leading end of subsequent sheets can be prevented from being caught in the ejection rollers 110.

Reference numeral 113 denotes a home-position sensor. The home-position sensor 113 is configured to detect the home position of the stacker tray 112 at the time of an initial operation. During a stacking operation, the home-position sensor 113 functions as a sheet-surface detecting sensor for the stacker tray 112. When a sheet is to be ejected, the home-position sensor 113 allows the stacker tray 112 to be positioned at the home position, which is a sheet stackable position as shown in FIG. 3.

Figure 4:
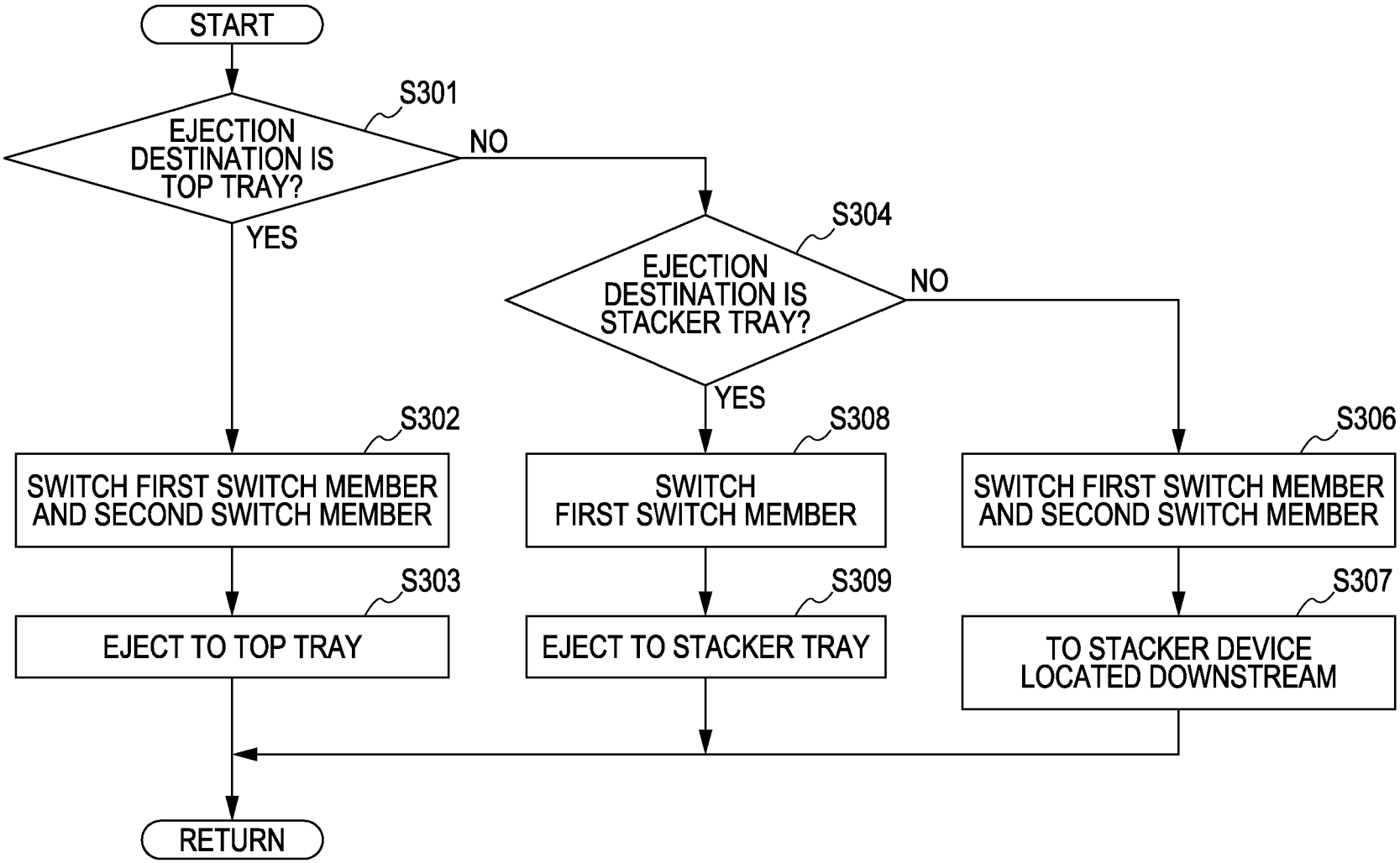
FIG. 4 is a flow chart illustrating a sheet stacking operation performed in the stacker.

A sheet stacking operation performed by the stacker 100 having the above-described configuration will be described below with reference to a flowchart shown in FIG. 4.

When ejected from the image-forming-apparatus main body 901, a sheet is conveyed into the stacker 100 via a pair of entrance rollers 101 until the sheet reaches the first switch member 103. Before the sheet is conveyed, the stacker control portion 210 preliminarily receives information about the sheet, such as the sheet size, the type of sheet, and the ejection destination of the sheet, from the CPU circuit portion 206 in the controller 960 of the image-forming-apparatus main body 901.

In step S301, the stacker control portion 210 determines whether or not the ejection destination of the sheet sent from the controller 960 is the top tray 106. If the ejection destination of the sheet is the top tray 106 (YES in step S301), the first switch member 103 and the second switch member 108 are switched to positions indicated by dash lines in FIG. 3 in step S302. Consequently, the sheet is guided to a pair of conveying rollers 104. The sheet is then ejected onto the top tray 106 by a pair of ejection rollers 105 in step S303 so as to become stacked on the top tray 106.

If the ejection destination of the sheet is not the top tray 106 (NO in step S301), the operation proceeds to step S304 where it is determined whether or not the ejection destination is the stacker tray 112. If it is determined that the ejection destination is not the stacker tray 112 (NO in step S304) or, for example, if it is determined that the ejection destination of the sheet is the stacker device (not shown) located downstream, the operation proceeds to step S306 where the first switch member 103 is switched to the position indicated by the dash line whereas the second switch member 108 is switched to the position indicated by the solid line in FIG. 3. Consequently, the sheet conveyed by the entrance rollers 101 is subsequently conveyed by pairs of conveying rollers 102 so as to be guided to a pair of exit rollers 109. Subsequently, in step S307, the sheet is conveyed to the stacker device (not shown) located downstream.

If the ejection destination of the sheet is the stacker tray 112 (YES in step S304), the operation proceeds to step S308 where the first switch member 103 is switched to the position indicated by the solid line. Consequently, the sheet is conveyed to the ejection rollers 110 while being guided by the first switch member 103. Subsequently, in step S309, the sheet is ejected onto the stacker tray 112.

Before the sheet reaches the ejection rollers 110, a timing sensor 111 disposed upstream of the ejection rollers 110 detects the passage timing of the leading end of the sheet. The sheet is then conveyed by the ejection rollers 110 so as to come into abutment with the tapered surface 115*a* of the sheet drawing unit 115. The leading end of the sheet is conveyed and guided along the tapered surface 115*a* towards the stacker tray 112 so as to be led to the knurled belt 116. In this case, the sheet comes into abutment with the knurled belt 116 due to the inertial force, i.e., momentum, generated as the result of the conveying process.

Subsequently, the knurled belt 116 forces the sheet to enter between the knurled belt 116 and the stacker tray 112 or between the knurled belt 116 and the topmost sheet in the case where there is already a stack of sheets.

After the sheet is ejected in this manner, an alignment plate 119 is shifted in the width direction, which is perpendicular to the sheet conveying direction, or, for example, towards the front side of the image-forming-apparatus main body 901 so as to align the stack of sheets in the width direction. After aligning the stack of sheets, the alignment plate 119 recedes in the width direction by a predetermined distance and waits for a new sheet to be conveyed. Subsequently, new sheets are sequentially stacked onto the stacker tray 112.

The stacker control portion 210 is configured to constantly monitor the top surface of the stack of ejected sheets through the sheet-surface detecting sensor 117. When the distance between the knurled belt 116 of the sheet drawing unit 115 and the top surface of the stack of sheets becomes smaller than a predetermined value, the stacker tray 112 is lowered by a predetermined distance. With such control, the space between the knurled belt 116 of the sheet drawing unit 115 and the top surface of the stack of sheets can be increased, thereby allowing for stacking of subsequent sheets.

By repeating this process, sheets can be stacked sequentially onto the stacker tray 112 until the stacker tray 112 reaches a fully loaded state. A fully loaded state of the stacker tray 112 is detected by the stacker control portion 210. Specifically, the stacker control portion 210 counts the number of detection signals from the timing sensor 111 acting as a sheet detecting unit that detects sheets ejected from the ejection rollers 110.

Figure 5:
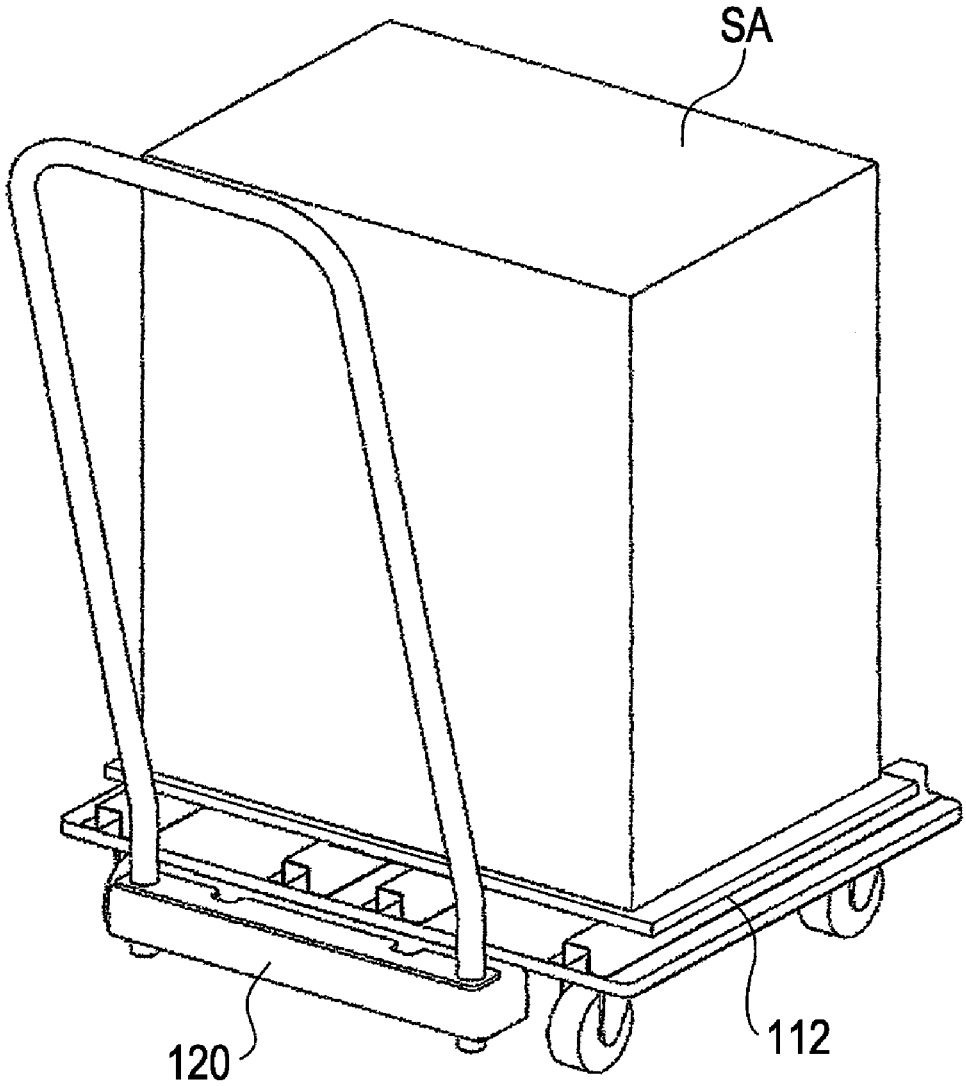
FIG. 5 illustrates a state where a stacker tray of the stacker is fully loaded and thus lowered, and the stacker tray holding the stack of sheets is placed on a dolly.

When a fully loaded state of the stacker tray 112 is detected in this manner, the stacker control portion 210 drives the lifting/lowering motor 800 so as to lower the stacker tray 112. The stacker tray 112 holding the stack of sheets is then placed on a dolly 120 shown in FIG. 5. After the stacker tray 112 is placed on the dolly 120 in this fashion, the dolly 120, serving as an unloading unit, is unloaded from the stacker 100, whereby the stack of sheets SA held by the stacker tray 112 can be entirely taken out of the stacker 100.

Subsequently, the stack of sheets SA is removed from the dolly 120, the dolly 120 and the stacker tray 112 are reloaded into the stacker 100, and the stacker tray 112 is lifted upward. As a result, the stacker tray 112 is placed back into the position shown in FIG. 3, thereby allowing for a new sheet stacking operation.

Figure 6:
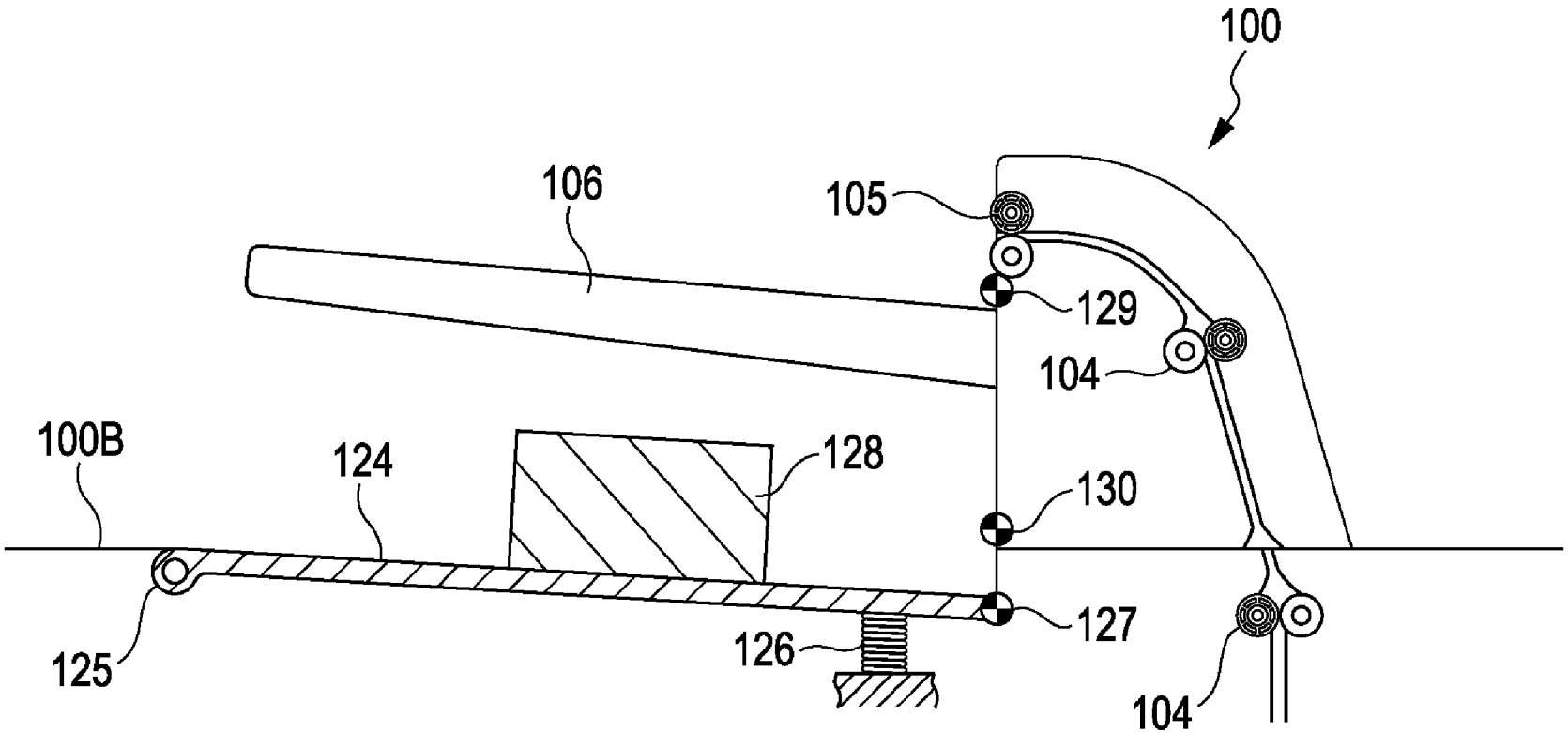
FIG. 6 illustrates an upper section of the stacker.

FIG. 6 illustrates the upper section of the stacker 100. In FIG. 6, reference numeral 100B denotes the upper surface of the stacker 100. An area of the upper surface 100B that faces the top tray 106 is provided with a foreign-object detecting cover 124 serving as a detecting member on which an object, such as sheets, can be placed. The foreign-object detecting cover 124 is vertically rotatable about a rotary shaft 125.

In FIG. 6, reference numeral 126 denotes a compression spring serving as a biasing unit configured to bias the foreign-object detecting cover 124 upward. By being biased by the compression spring 126, the foreign-object detecting cover 124 is brought into pressure contact with a stopper (not shown) so as to be held at a position where the foreign-object detecting cover 124 is flush with the upper surface 100B of the stacker 100.

The top-tray sheet-surface detecting sensor 129 is configured to detect the distance between the topmost one of sheets stacked on the vertically movable top tray 106 and the pair of ejection rollers 105. Reference numeral 130 denotes a full-load detecting sensor. The foreign-object detecting sensor 127 serves as a detecting unit configured to, for example, optically detect the movement of the foreign-object detecting cover 124 caused by an object (referred to as a "foreign object" hereinafter) 128 placed on the foreign-object detecting cover 124, which is biased counterclockwise about the rotary shaft 125 by the compression spring 126.

In this embodiment, when the foreign object 128 placed on the foreign-object detecting cover 124 has a predetermined weight or more, the foreign-object detecting cover 124 rotates downward (clockwise) against the biasing force of the compression spring 126. When such a foreign object 128 is placed on the foreign-object detecting cover 124, the foreign-object detecting sensor 127 detects the foreign-object detecting cover 124 in a downward rotated state as the result of the load of the foreign object 128, whereby the foreign-object detecting sensor 127 can detect that the foreign object 128 has been placed on the foreign-object detecting cover 124. Although the foreign-object detecting cover 124 in this embodiment is described as a plate-like member, the foreign-object detecting cover 124 is not limited to this and may alternatively have, for example, a button-like shape, a rod-like shape, or a spherical shape. It is preferable however that the foreign-object detecting cover 124 be a plate-like member with a certain surface area in order to achieve a wide detection range for the detection of the foreign object 128.

An operation performed when ejecting a sheet onto the top tray 106 of the stacker 100 will now be described.

In FIG. 6, the stacker 100 is in a standby mode and is waiting for a sheet to be conveyed from the image-forming-apparatus main body 901. In the case where a sheet is to be ejected onto the top tray 106 as described above, the sheet is conveyed to the ejection rollers 105 by the conveying rollers 104, and is then ejected and stacked onto the top tray 106 by the ejection rollers 105.

Subsequently, sheets are sequentially ejected from the ejection rollers 105, and when the distance between the topmost sheet and the ejection rollers 105 becomes smaller than a predetermined value, the top-tray sheet-surface detecting sensor 129 detects this state. Based on the detection signal from the top-tray sheet-surface detecting sensor 129, the stacker control portion 210 drives the top-tray lifting/lowering motor 801 so as to lower the top tray 106 by a predetermined distance, thereby allowing more sheets to be stacked on the top tray 106. By repeating this operation, a large number of sheets can be stacked on the top tray 106.

On the other hand, as more sheets are stacked, the top tray 106 descends to a position corresponding to a fully loaded state. When the full-load detecting sensor 130 detects this state, the stacker control portion 210 notifies the CPU circuit portion 206 that the top tray 106 is in a fully loaded state on the basis of the detection signal from the full-load detecting sensor 130, thereby terminating or temporarily stopping the stacking operation.

As shown in FIG. 6, there is a case where the user may place the foreign object 128 within the operating range of the top tray 106, that is, on the foreign-object detecting cover 124 while the stacker 100 is in operation or in a standby mode. In that case, the foreign-object detecting cover 124 rotates clockwise about the rotary shaft 125 due to the self weight (load) of the foreign object 128, causing one edge of the foreign-object detecting cover 124 to block the light from the foreign-object detecting sensor 127. As a result, the stacker control portion 210 detects that the foreign object 128 is placed on the foreign-object detecting cover 124.

When detecting that the foreign object 128 is placed on the foreign-object detecting cover 124 in this manner, the stacker control portion 210 sends a signal indicating the detection of the foreign object 128 to the CPU circuit portion 206. In response to this signal, the CPU circuit portion 206 allows the touch panel 209*a* provided in the operating portion 209 to display a message instructing removal of the foreign object or a message indicating that a foreign object has been placed on the stacker 100. In addition, the CPU circuit portion 206 stops the image forming operation as well as the conveying operation of sheets to the stacker 100.

Figure 7:
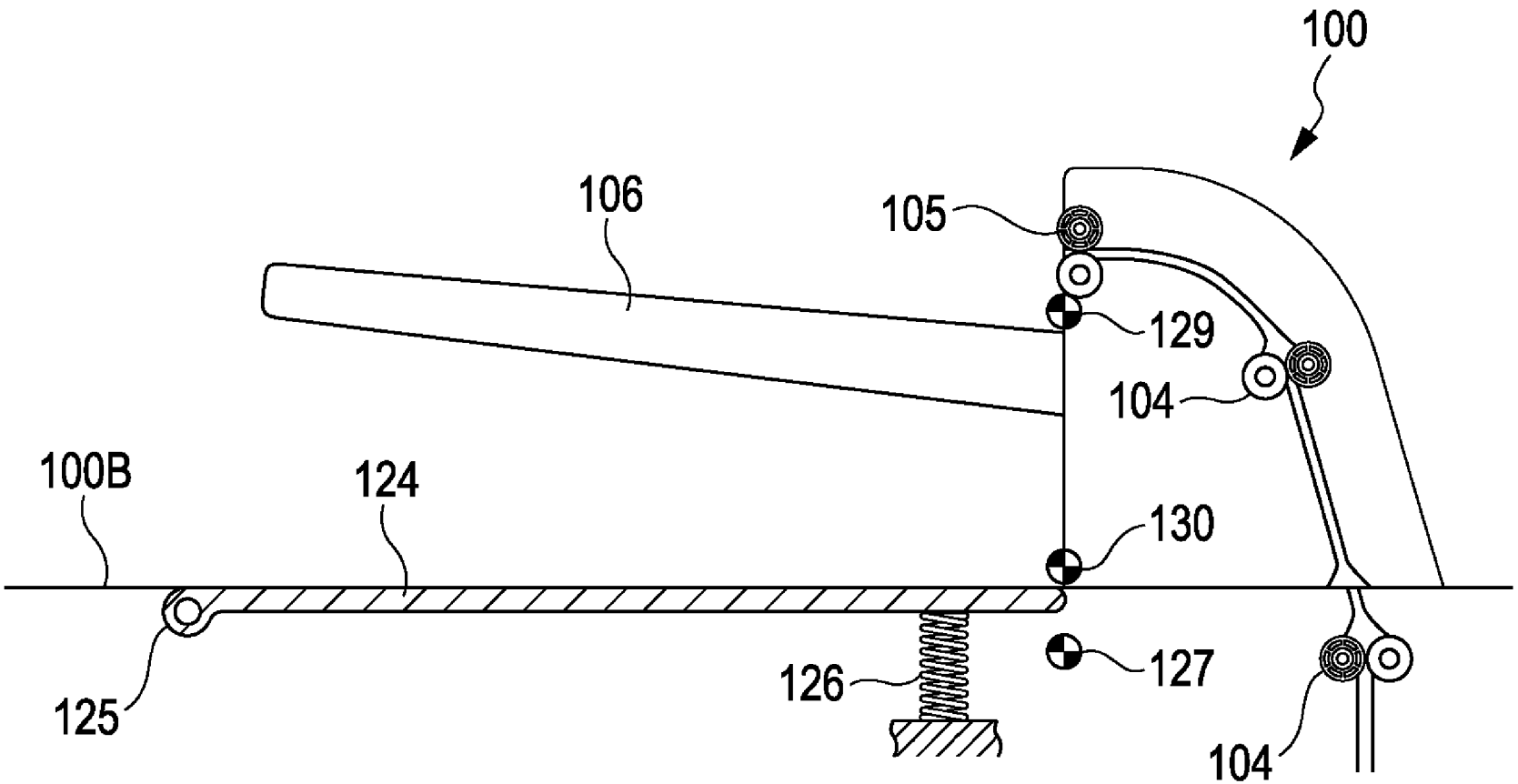
FIG. 7 illustrates a state where a foreign object has been removed from a foreign-object detecting cover provided at the upper surface of the stacker.

When the user viewing this displayed message removes the foreign object 128 from the foreign-object detecting cover 124, the compression spring 126 forces the foreign-object detecting cover 124 to rotate counterclockwise about the rotary shaft 125 as shown in FIG. 7. In consequence, the foreign-object detecting sensor 127 outputs a signal indicating that the foreign object 128 has been removed. Based on this signal, the stacker control portion 210 detects that the foreign object 128 has been removed from the foreign-object detecting cover 124.

Upon detection of the removal of the foreign object 128 in this manner, the stacker control portion 210 notifies the CPU circuit portion 206 of this state. The CPU circuit portion 206 notified of the removal of the foreign object 128 resumes the image forming operation and the conveying operation of sheets to the stacker 100.

Figure 8:
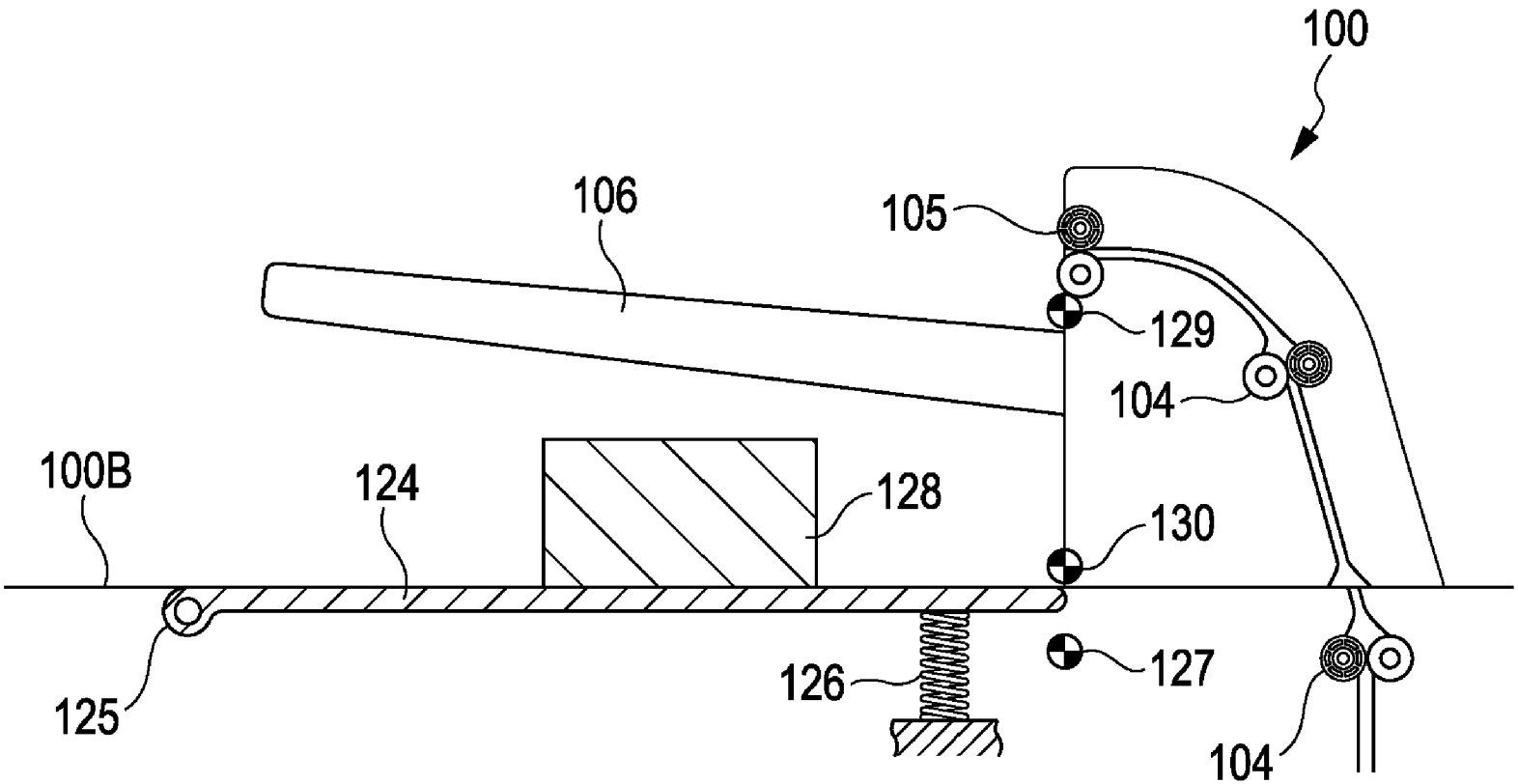
FIG. 8 illustrates a state where a lightweight foreign object is placed on the foreign-object detecting cover.

In the case where the user places the foreign object 128 on the foreign-object detecting cover 124 while the stacker 100 is in operation or in a standby mode, if the foreign object 128 is light, the foreign-object detecting cover 124 remains still with the foreign object 128 placed thereon as shown in FIG. 8. In that case, the foreign-object detecting cover 124 does not rotate, which means that the stacker control portion 210 cannot detect that the foreign object 128 is placed on the foreign-object detecting cover 124.

Therefore, in this embodiment, sheets are ejected onto the top tray 106 until the foreign-object detecting sensor 127 detects that the foreign object 128 is placed on the foreign-object detecting cover 124. When the foreign-object detecting sensor 127 detects that the foreign object 128 is placed on the foreign-object detecting cover 124, a message indicating that a foreign object has been placed on the stacker 100 is displayed.

In other words, the CPU circuit portion 206 continues or starts the image forming operation and the conveying operation of sheets to the stacker 100. Accordingly, sheets are sequentially conveyed to the stacker 100 and are subsequently ejected onto the top tray 106. When the distance between the topmost sheet and the ejection rollers 105 becomes smaller than a predetermined value, the stacker control portion 210 drives the top-tray lifting/lowering motor 801 so as to lower the top tray 106 by a predetermined distance, thereby allowing more sheets to be stacked onto the top tray 106. By repeating this operation, a large number of sheets can be stacked on the top tray 106.

Figure 10:
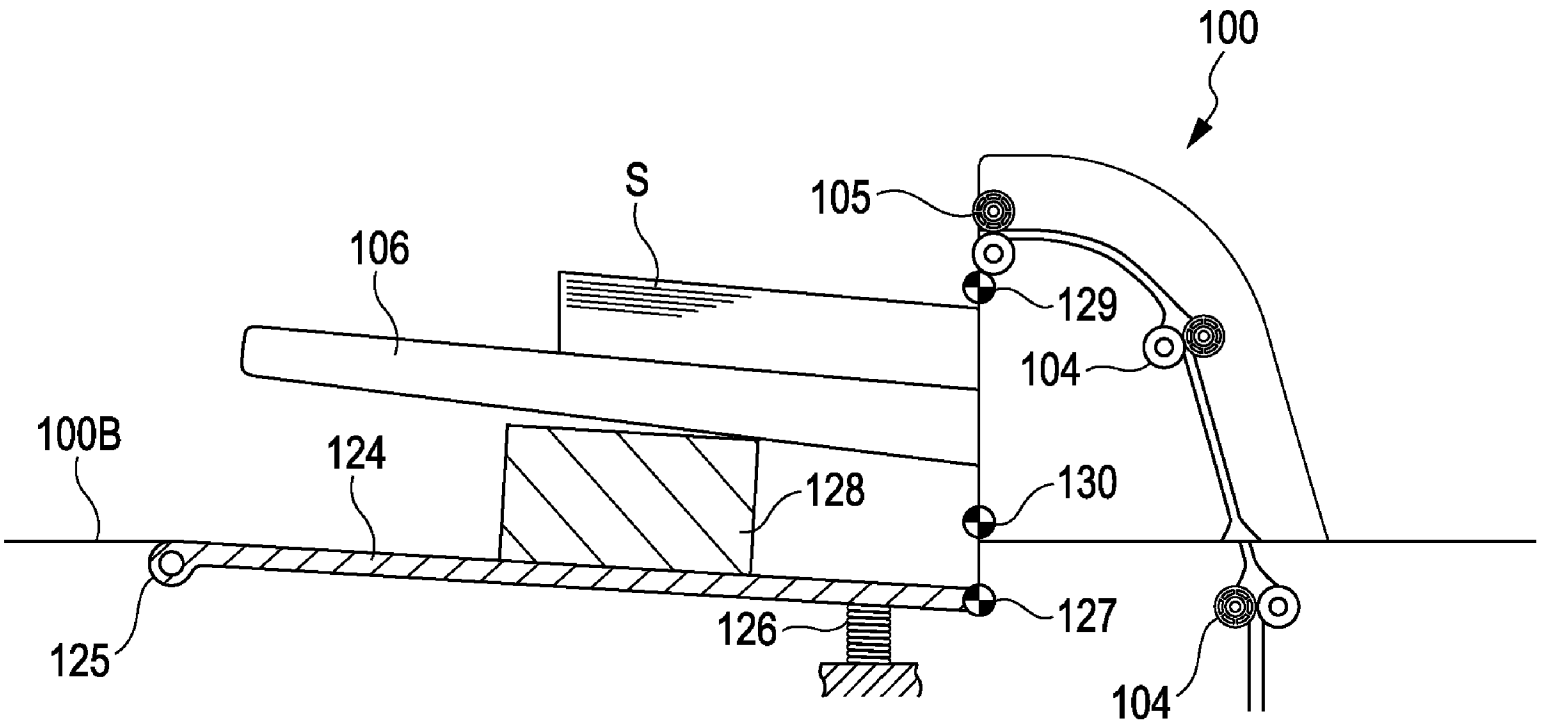
FIG. 10 illustrates a detecting operation of a foreign object with respect to sheets in the stacker.

As the sheets are sequentially stacked onto the top tray 106 to cause the top tray 106 to descend, the lower surface of the top tray 106 comes into abutment with the foreign object 128, as shown in FIG. 10, so as to press the foreign object 128 from above. When the foreign object 128 placed on the foreign-object detecting cover (movable member) 124 is pressed from above by the top tray 106 in this manner, the foreign-object detecting cover 124 rotates clockwise about the rotary shaft 125.

The rotation of the foreign-object detecting cover 124 causes one edge of the foreign-object detecting cover 124 to block the light from the foreign-object detecting sensor 127. Consequently, the stacker control portion 210 sends a signal indicating the detection of the foreign object 128 to the CPU circuit portion 206. In response to this signal, the CPU circuit portion 206 allows the touch panel 209*a* provided in the operating portion 209 to display a message instructing removal of the sheets stacked on the top tray 106. Furthermore, the CPU circuit portion 206 stops the image forming operation as well as the conveying operation of sheets to the stacker 100.

Figure 9:
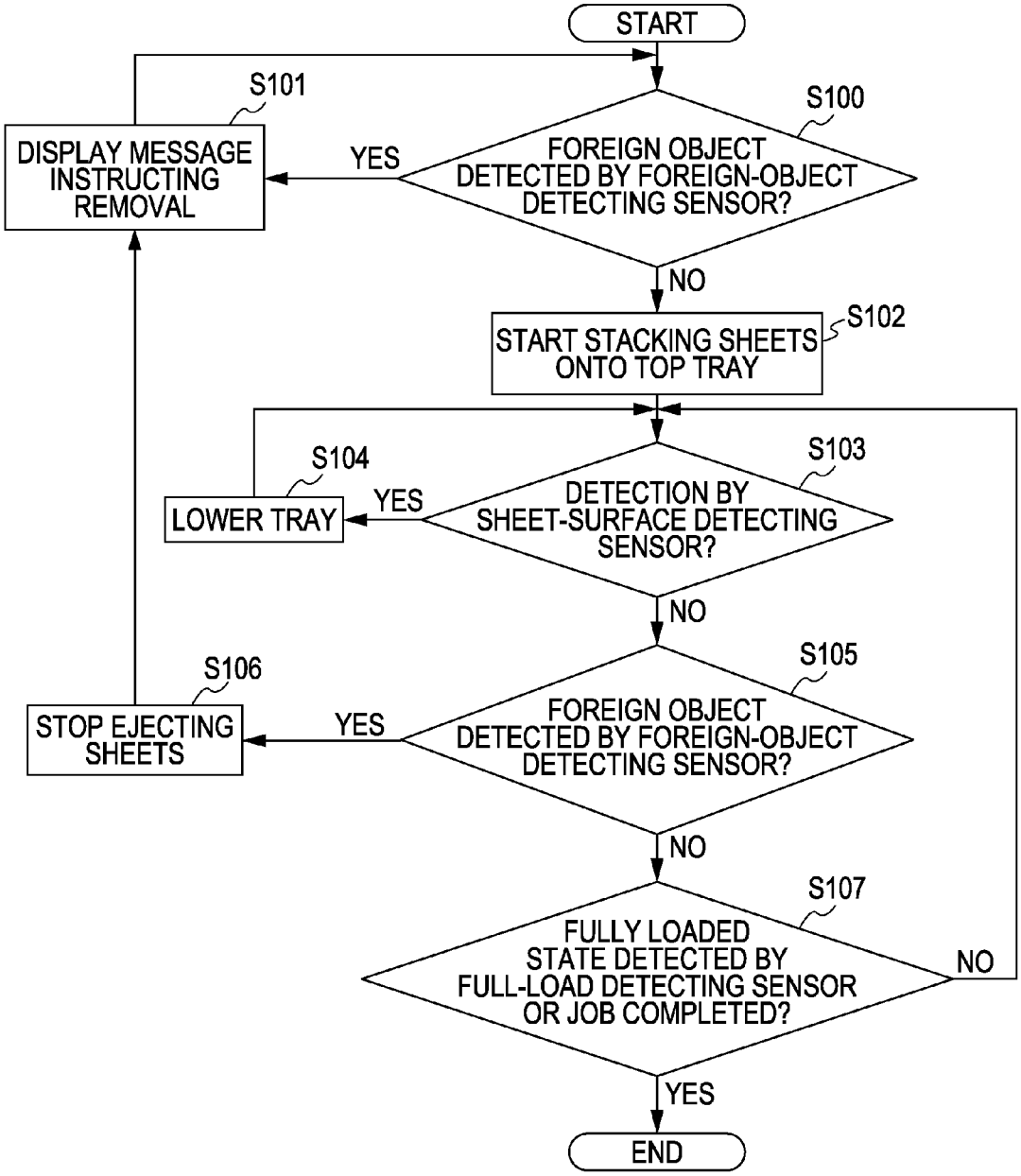
FIG. 9 is a flow chart illustrating a foreign-object detecting operation performed in the stacker.

A foreign-object detecting operation performed in the stacker 100 having the above-described configuration will be described below with reference to a flow chart shown in FIG. 9.

First, before ejecting sheets onto the top tray 106, it is determined in step S100 whether a foreign object is detected by the foreign-object detecting sensor 127. If a foreign object is detected by the foreign-object detecting sensor 127 (YES in step S100), a message instructing removal of the foreign object is displayed in step S101.

If a foreign object is not detected by the foreign-object detecting sensor 127 (NO in step S100), a sheet is ejected onto the top tray 106 as described above so as to start stacking sheets onto the top tray 106 in step S102.

Subsequently, when a predetermined number of sheets is stacked and the distance between the topmost sheet and the ejection rollers 105 becomes smaller than a predetermined value, the top-tray sheet-surface detecting sensor 129 detects this state (YES in step S103). Based on the detection signal from the top-tray sheet-surface detecting sensor 129, the stacker control portion 210 drives the top-tray lifting/lowering motor 801 so as to lower the top tray 106 by a predetermined distance in step S104, thereby allowing more sheets to be stacked on the top tray 106. By repeating this operation, a large number of sheets can be stacked on the top tray 106.

When a large number of sheets S are stacked on the top tray 106 as shown in FIG. 10 and the top tray 106 is subsequently lowered by a predetermined distance on the basis of the detection by the top-tray sheet-surface detecting sensor 129, the foreign object 128 becomes pressed by the lower surface of the top tray 106. This forces the foreign-object detecting cover 124 to rotate clockwise about the rotary shaft 125, thereby causing one edge of the foreign-object detecting cover 124 to block the light from the foreign-object detecting sensor 127. Based on this blocking of the light from the foreign-object detecting sensor 127, the stacker control portion 210 detects that the foreign object 128 is placed on the foreign-object detecting cover 124.

When the foreign-object detecting sensor 127 detects a foreign object in this manner (YES in step S105), the stacker control portion 210 sends a signal indicating the detection of the foreign object to the CPU circuit portion 206. In response to this signal, the CPU circuit portion 206 stops the image forming operation as well as the conveying operation of sheets to the stacker 100, thereby stopping the ejection of sheets to the top tray 106 in step S106. Then, the CPU circuit portion 206 allows the touch panel 209*a* provided in the operating portion 209 to display a message instructing removal of the foreign object in step S101.

In this embodiment, the ejection of sheets to the top tray 106 is stopped immediately upon detection of a foreign object by the foreign-object detecting sensor 127. Alternatively, the ejection of sheets to the top tray 106 may be stopped after first stopping the image forming operation in the image-forming-apparatus main body 901 on the basis of a signal output from the foreign-object detecting sensor 127 in accordance with downward movement of the foreign-object detecting cover 124 and then ejecting all of the sheets remaining inside the image-forming-apparatus main body 901 and the stacker 100 onto the top tray 106. In this embodiment, even if the top tray 106 is lowered further after the foreign object 128 comes into contact with the top tray 106, the foreign-object detecting cover 124 is still able to rotate downward along with the lowering of the top tray 106. Accordingly, the stacking of sheets onto the top tray 106 is possible even after the detection of the foreign object 128 on the foreign-object detecting cover 124. Thus, even when all of the sheets remaining inside the image-forming-apparatus main body 901 and the stacker 100 are ejected onto the top tray 106 after the detection of a foreign object by the foreign-object detecting sensor 127, the sheets can still be ejected onto the top tray 106 while maintaining the stackability of the sheets.

When the user viewing the displayed message removes the foreign object 128 from the stacker 100, the compression spring 126 forces the foreign-object detecting cover 124 to rotate counterclockwise about the rotary shaft 125 as shown in FIG. 7, thus cancelling the blocking of light by the foreign-object detecting cover 124. In consequence, the foreign-object detecting sensor 127 outputs a signal indicating that the foreign object 128 has been removed. Based on this signal, the stacker control portion 210 detects that the foreign object 128 has been removed from the foreign-object detecting cover 124.

When the foreign object 128 is removed from the foreign-object detecting cover 124 such that the foreign-object detecting sensor 127 stops detecting a foreign object (NO in step S105), the stacking of sheets onto the top tray 106 resumes. Subsequently, when the full-load detecting sensor 130 detects a fully loaded state or when the job is completed (YES in step S107), the sheet stacking operation ends.

Accordingly, in this embodiment, when the foreign-object detecting sensor 127 detects downward movement of the foreign-object detecting cover 124 due to placement of a foreign object, the stacking of sheets onto the top tray 106 is stopped until the detection by the foreign-object detecting sensor 127 is released. In other words, the stacking of sheets onto the top tray 106 is performed after the foreign object is removed from below the top tray 106. Accordingly, sheets can be stacked onto the top tray 106 in the state where the object is assuredly removed from below the top tray 106.

Figure 11:
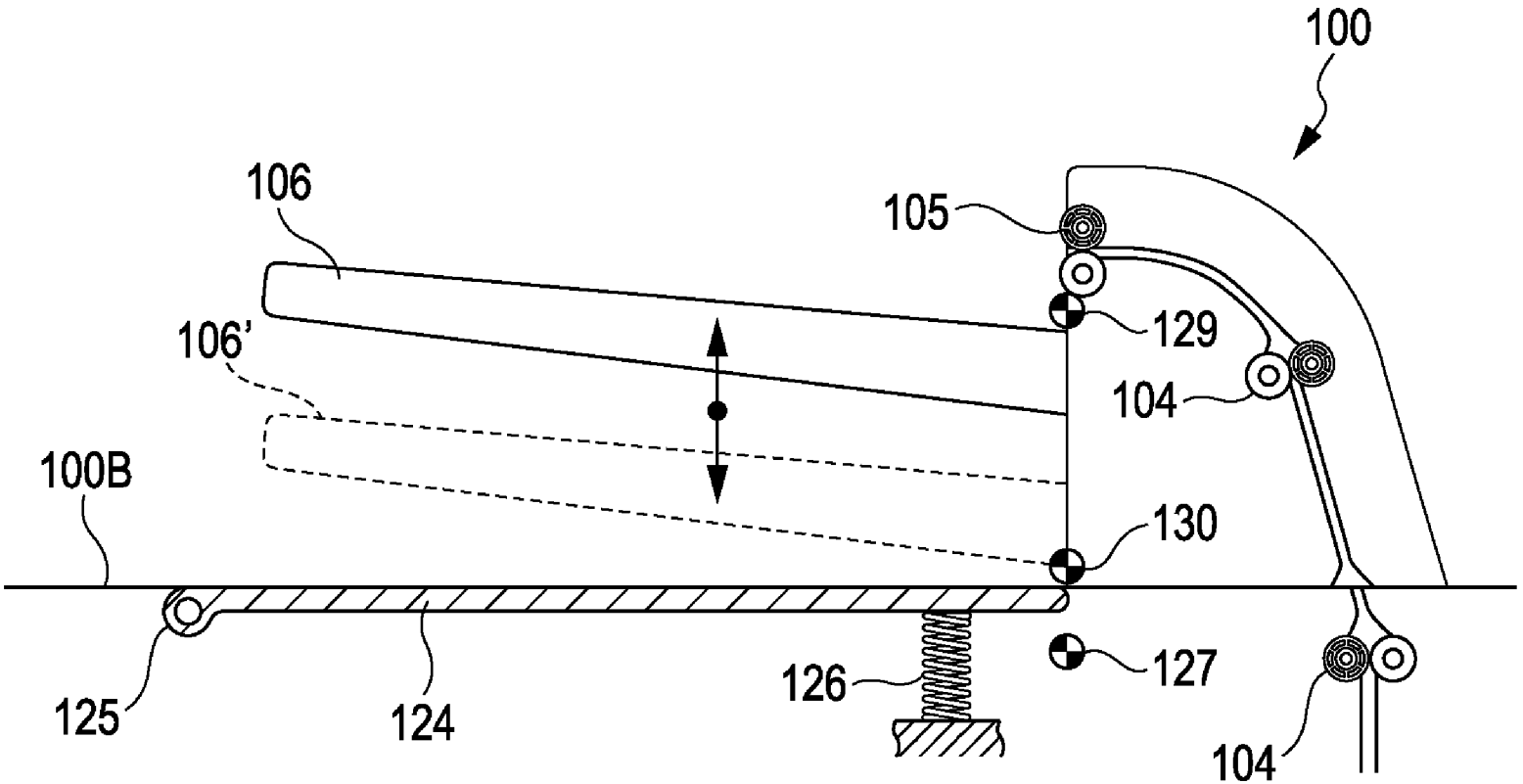
FIG. 11 illustrates an operation for confirming the presence or absence of a foreign object in the stacker.

Referring to FIG. 11, in this embodiment, after it is determined that the foreign object has been removed on the basis of the signal from the foreign-object detecting sensor 127, the top tray 106 is configured to be liftable/lowerable over the entire operating range thereof. Specifically, after the detection by the foreign-object detecting sensor 127 is released, the top tray 106 is temporarily lowered prior to starting the stacking of sheets onto the top tray 106.

Accordingly, this allows for automatic detection of whether the foreign object is removed. After confirming the absence of the foreign object in this manner, the stacking of sheets onto the top tray 106 can be resumed, whereby sheets can be stacked onto the top tray 106 in the state where the object is assuredly removed from below the top tray 106.

In this embodiment, the ejection of sheets onto the top tray 106 is stopped in the state where a foreign object is detected by the foreign-object detecting sensor 127. Alternatively, the lowering of the top tray 106 by driving the top-tray lifting/lowering motor 801 may be restricted in the state where a foreign object is detected by the foreign-object detecting sensor 127. In that case, in the state where a foreign object is detected by the foreign-object detecting sensor 127, the top tray 106 is prevented from being lowered regardless of the detection result of the top-tray sheet-surface detecting sensor 129. Although the above embodiment is directed to the stacker 100 for stacking ejected sheets, the embodiment can alternatively be applied to, for example, a sheet stacking device for stacking sheets to fed.

Second Exemplary Embodiment

A second exemplary embodiment of the present invention differs from the first exemplary embodiment in that the top tray 106 is lifted upward upon detection of a foreign object. The differences will be described in detail below, whereas descriptions of other points that are the same as the first embodiment will be omitted.

Figure 12:
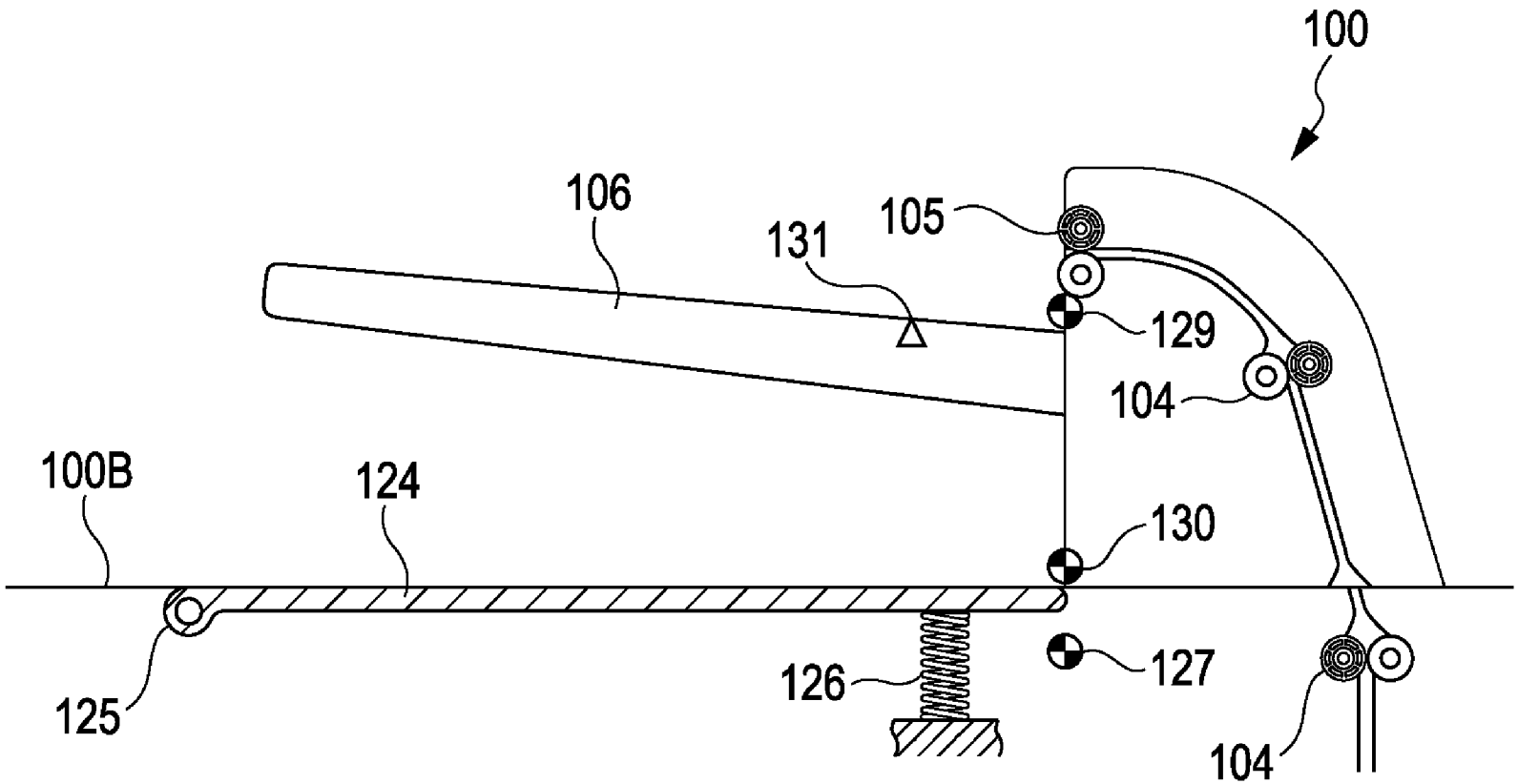
FIG. 12 illustrates a stacker according to a second exemplary embodiment of the present invention.

FIG. 12 is a cross-sectional view of a stacker 100 according to the second embodiment. Reference numeral 131 denotes a top-tray sheet-detecting sensor configured to detect the presence or absence of a sheet or sheets on the top tray 106. The top-tray sheet-surface detecting sensor 129, the full-load detecting sensor 130, the foreign-object detecting sensor 127, and the top-tray sheet-detecting sensor 131 are connected to the stacker control portion 210 as shown in FIG. 2.

The foreign-object detecting cover 124 rotates and thus causes one edge of the foreign-object detecting cover 124 to block the light from the foreign-object detecting sensor 127. Consequently, the stacker control portion 210 sends a signal indicating detection of a foreign object 128 to the CPU circuit portion 206. In response to this signal, the CPU circuit portion 206 allows the touch panel 209*a* provided in the operating portion 209 to display a message instructing removal of sheets stacked on the top tray 106.

Subsequently, the stack of sheets is removed from the top tray 106, and when the top-tray sheet-detecting sensor 131 detects this state, the top-tray lifting/lowering motor 801 is driven so as to lift the top tray 106 to the uppermost position. By lifting the top tray 106 to the uppermost position where the distance between the top tray 106 and the ejection rollers 105 reaches a predetermined value, the foreign object 128 becomes readily removable.

As an alternative to the above-described embodiment, in the case where the sheets are partly removed from the top tray 106, the top tray 106 may be lifted upward until the top-tray sheet-surface detecting sensor 129 detects the top surface of the stack of remaining sheets. However, in order to remove a foreign object readily, a certain space between the top tray 106 and the foreign object is necessary for the removal, which means that the top tray 106 needs to be lifted upward by a predetermined distance.

Whether or not the top tray 106 is lifted by a predetermined distance can be determined on the basis of a calculation result obtained by counting the number of times the top-tray lifting/lowering motor 801 is rotated. If the top tray 106 is not lifted upward by a predetermined distance, the touch panel 209*a* redisplays the message instructing removal of sheets stacked on the top tray 106.

After the top tray 106 is lifted to the uppermost position, the touch panel 209*a* displays a message instructing removal of the foreign object 128. When this message is displayed, the user may remove the foreign object 128 and press a button displayed on the touch panel 209*a* to confirm that the foreign object 128 has been removed. Accordingly, the CPU circuit portion 206 and the stacker control portion 210 are notified that the foreign object 128 has been removed, and the stacker 100 resumes the stacking of sheets onto the top tray 106.

Figure 13:
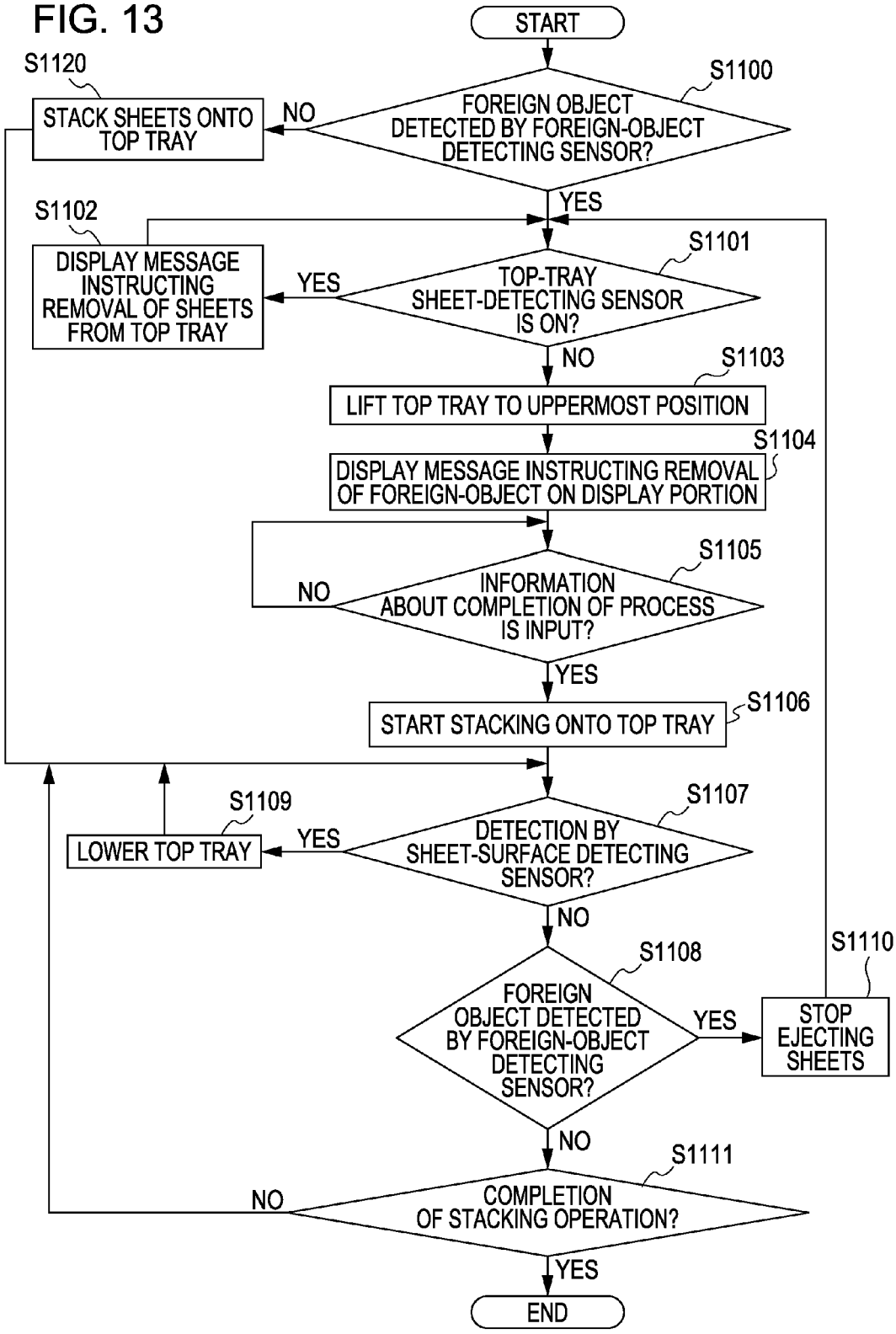
FIG. 13 is a flow chart illustrating a foreign-object detecting operation performed in the stacker according to the second embodiment.

The detecting operation of a foreign object during the stacking of sheets onto the top tray 106 of the stacker 100 will be described below with reference to a flow chart shown in FIG. 13.

When the CPU circuit portion 206 commands stacking of sheets onto the top tray 106, the stacker control portion 210 first determines in step S1100 whether a foreign object is detected by the foreign-object detecting sensor 127 before ejecting sheets onto the top tray 106, that is, before starting the stacking operation. If a foreign object is not detected by the foreign-object detecting sensor 127 (NO in step S1100), sheets are stacked onto the top tray 106 in step S1120.

As the stacking of sheets onto the top tray 106 continues, the number of stacked sheets increases, causing the top tray 106 to descend gradually. In other words, when the distance between the topmost sheet and the ejection rollers 105 becomes smaller than a predetermined value, the top-tray sheet-surface detecting sensor 129 detects this state (YES in step S1107). Based on the detection signal from the top-tray sheet-surface detecting sensor 129, the stacker control portion 210 drives the top-tray lifting/lowering motor 801 so as to lower the top tray 106 by a predetermined distance in step S1109.

If a foreign object is not detected by the foreign-object detecting sensor 127 even after the top tray 106 is lowered due to an increase in the number of stacked sheets (NO in step 1108), and then a fully loaded state is detected by the full-load detecting sensor 130 or the stacking of sheets is completed (YES in step S1111), the sheet stacking operation ends.

In the case where the foreign object placed on the foreign-object detecting cover 124 is light in weight, the foreign-object detecting sensor 127 may not detect the foreign object, but the foreign object is pressed by the descending top tray 106. This causes the foreign-object detecting cover 124 to rotate downward, whereby the foreign-object detecting sensor 127 can detect the foreign object (YES in step S1108).

When the foreign-object detecting sensor 127 detects the foreign object placed on the foreign-object detecting cover 124 in this manner (YES in step S1108), the CPU circuit portion 206 stops the image forming operation and the conveying operation of sheets to the stacker 100 so as to stop the ejection of sheets to the top tray 106 in step S1110. Furthermore, the stacker control portion 210 checks whether sheets are stacked on the top tray 106 on the basis of a signal from the top-tray sheet-detecting sensor 131 in step S1101.

In the case where sheets are stacked on the top tray 106, that is, when the top-tray sheet-detecting sensor 131 is in an ON mode (YES in step S1101), the touch panel 209*a* displays a message instructing removal of the sheets from the top tray 106 in step S1102. The sheets are then removed from the top tray 106 to cause the top-tray sheet-detecting sensor 131 to be switched to an OFF mode (NO in step S1101). The stacker control portion 210 then drives the top-tray lifting/lowering motor 801 so as to lift the top tray 106 to the uppermost position in step S1103.

Since the sheets are removed from the top tray 106 at this time, the top tray 106 can be lifted to the uppermost position. By lifting the top tray 106 to the uppermost position, the space between the foreign object 128 and the top tray 106 can be increased, whereby the foreign object 128 becomes readily removable.

Subsequently, the CPU circuit portion 206 allows the touch panel 209*a* provided in the operating portion 209 to display a message instructing removal of the foreign object in step S1104. The user may remove the foreign object 128 on the basis of the displayed message, and confirm that the foreign object 128 has been removed by, for example, pressing a confirmation button. When the information about the completion of the process indicating the removal of the foreign object 128 is input (notified) by the pressing of the button (YES in step S1105), the stacker control portion 210 resumes the stacking of sheets onto the top tray 106 in step S1106. Then, when a fully loaded state is detected by the full-load detecting sensor 130 or when the stacking of sheets is completed (YES in step S1111), the sheet stacking operation ends.

Figure 14:
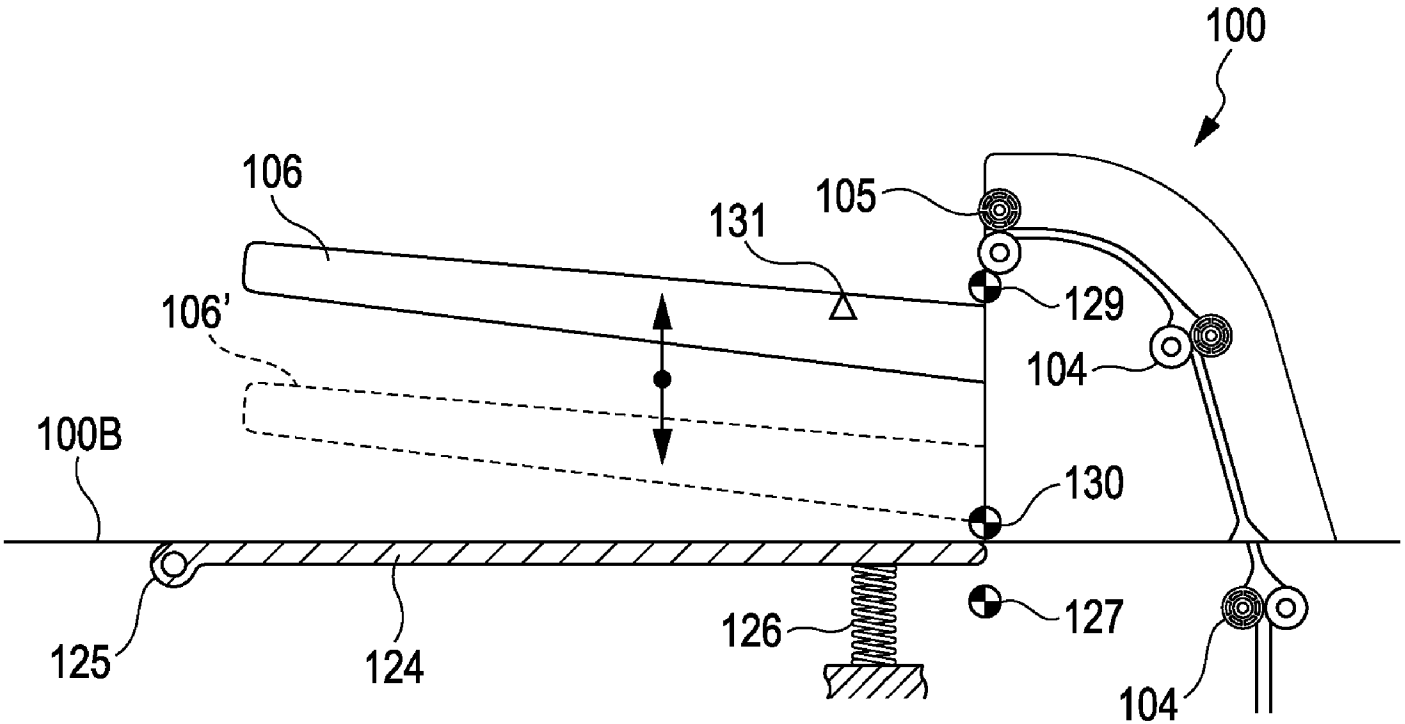
FIG. 14 illustrates a detecting operation of a foreign object with respect to sheets in the stacker according to the second embodiment.
Figure 15:
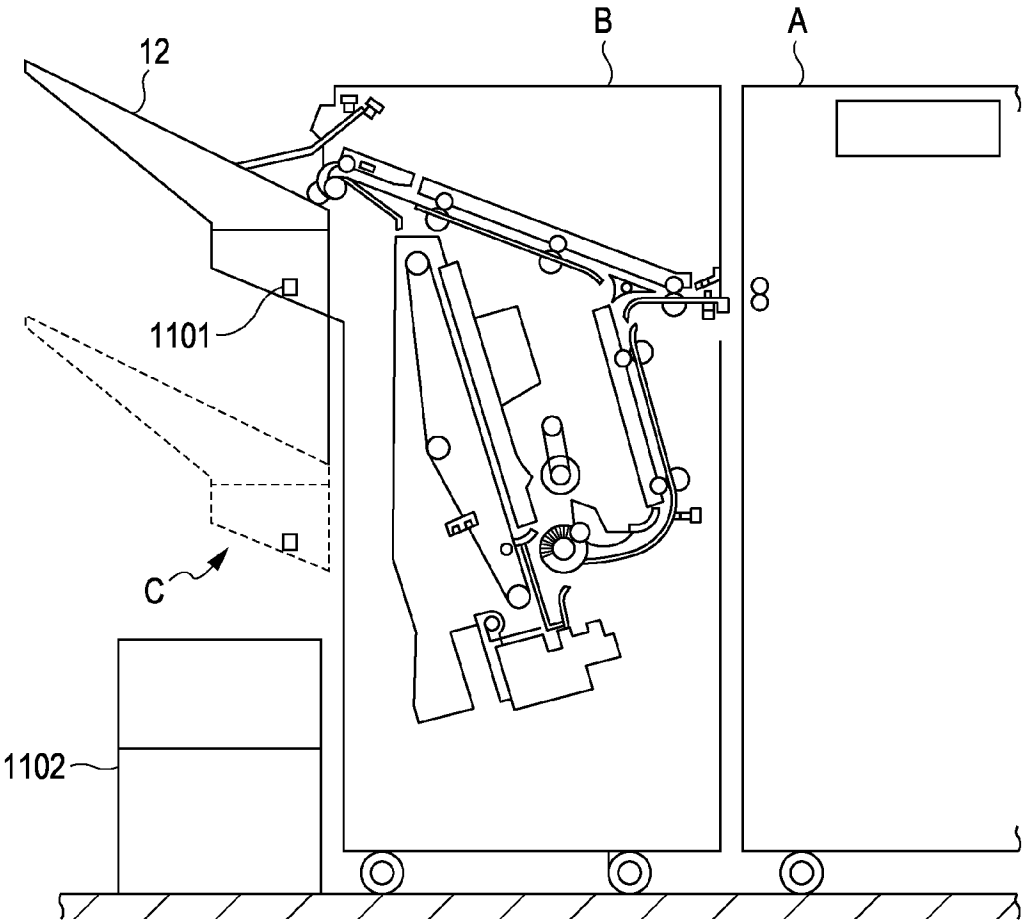
FIG. 15 PRIOR ART
FIG. 15 illustrates a sheet stacking device of related art.
Figure 16:
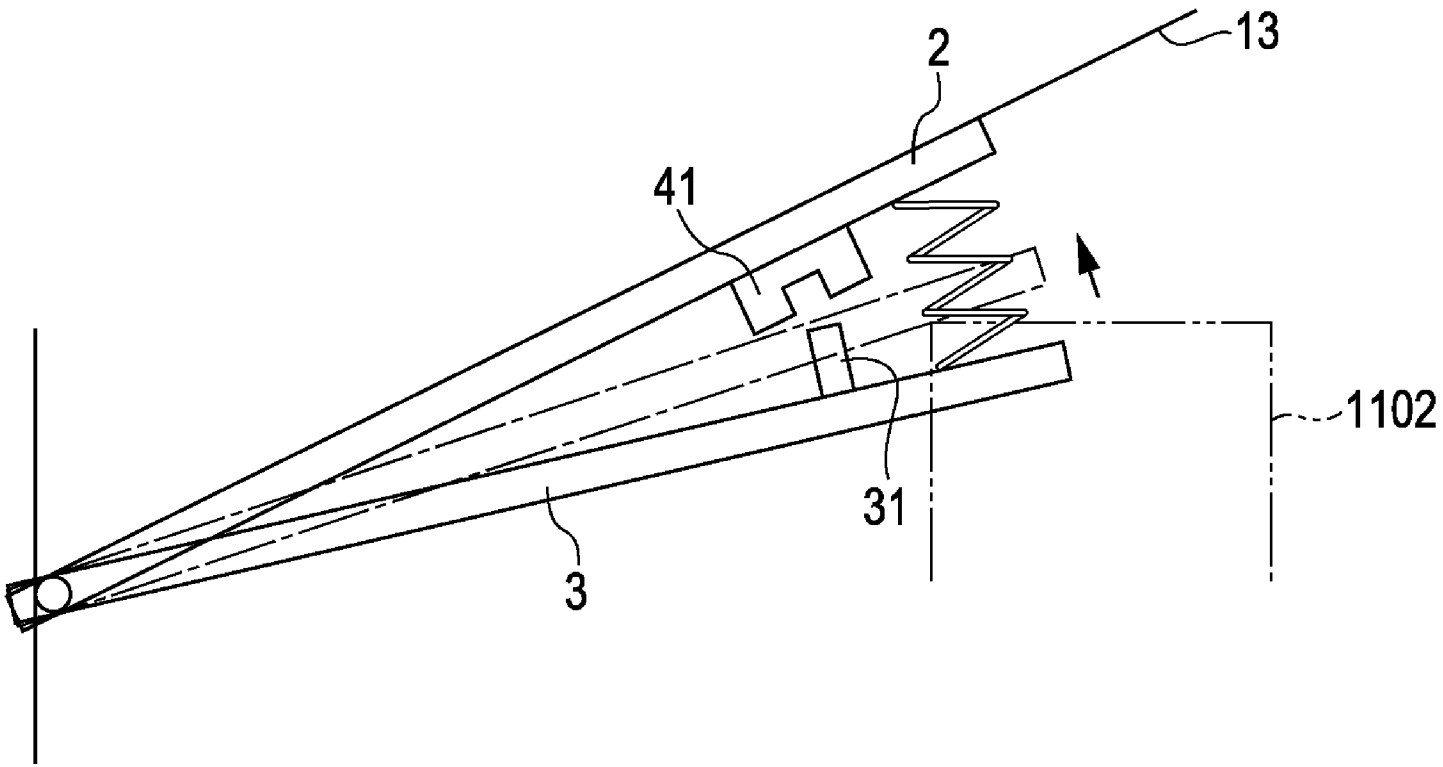
FIG. 16 PRIOR ART
FIG. 16 illustrates another sheet stacking device of related art.

Referring to FIG. 14, in the second embodiment, after it is determined that the foreign object has been removed on the basis of the signal from the foreign-object detecting sensor 127, the top tray 106 is configured to be liftable/lowerable over the entire operating range thereof. Specifically, after the detection by the foreign-object detecting sensor 127 is released, the top tray 106 is temporarily lowered prior to starting the stacking of sheets onto the top tray 106.

Accordingly, this allows for automatic detection of whether the foreign object is removed. After confirming the absence of the foreign object in this manner, the stacking of sheets onto the top tray 106 can be resumed, whereby sheets can be stacked onto the top tray 106 in the state where the object is assuredly removed from below the top tray 106.

As described above, in the second embodiment, when movement of the foreign-object detecting cover 124 is detected, the sheet stacking operation is stopped and the top tray 106 is lifted upward to a position where an object placed on the foreign-object detecting cover 124 is removable. Accordingly, the foreign object becomes readily removable.

Furthermore, in the second embodiment, when movement of the foreign-object detecting cover 124 is detected as described above, the sheets are removed from the top tray 106 and the top tray 106 is then lifted upward. Accordingly, the top tray 106 can be lifted to the uppermost position regardless of the number of sheets on the top tray 106 at the time of the detection of the movement of the foreign-object detecting cover 124.

In the second embodiment, even when the foreign-object detecting cover 124 is moved due to the self weight of a foreign object, the top tray 106 is still lifted to the uppermost position. This allows for easy removal of the foreign object not only when the top tray 106 and the foreign object are close to each other but also under any condition. Furthermore, with a foreign-object detecting cover that is configured to detect placement of a foreign object in the operating range of the top tray 106, the same advantages as the present invention can be achieved.

In the second embodiment, the ejection of sheets onto the top tray 106 is stopped in the state where a foreign object is detected by the foreign-object detecting sensor 127. Alternatively, the lowering of the top tray 106 by driving the top-tray lifting/lowering motor 801 may be restricted in the state where a foreign object is detected by the foreign-object detecting sensor 127. In that case, in the state where a foreign object is detected by the foreign-object detecting sensor 127, the top tray 106 is prevented from being lowered regardless of the detection result of the top-tray sheet-surface detecting sensor 129. Although the above embodiment is directed to the stacker 100 for stacking ejected sheets, the embodiment can alternatively be applied to, for example, a sheet stacking device for stacking sheets to fed.

Although the above embodiments are directed to an example in which a foreign object is detected in response to rotation of the foreign-object detecting cover 124, the present invention is not limited to this. For example, the foreign-object detecting cover may be a member that slides (descends) when a foreign object is placed thereon. In this case, the foreign object can be detected by detecting the movement of this foreign-object detecting cover.

Moreover, in the above embodiments, a touch-panel display portion is used as a unit that notifies (informs) a user that a foreign object is placed on the cover. However, the present invention is not limited to this. For example, a stacker display portion may be provided for displaying the placement of a foreign object, or an audio message may be used for notifying the user.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-296446 filed Nov. 15, 2007 and No. 2008-047143 filed Feb. 28, 2007, which are hereby incorporated by reference herein in their entirety.

What is claimed is:

1. A sheet stacking device including a liftable/lowerable sheet stacking portion on which sheets to be ejected are stackable, the sheet stacking portion being movable downward as an amount of stacked sheets increases, the sheet stacking device comprising:

a movable member disposed below the sheet stacking portion with a space therebetween; and a detecting portion configured to output a signal in accordance with a position of the movable member, wherein when an object having a predetermined weight or more is placed on the movable member, the movable member moves downward, and wherein ejection of the sheet to the sheet stacking portion is stopped based on the signal output from the detecting portion in accordance with the downward movement of the movable member.

2. The sheet stacking device according to claim 1, further comprising a biasing portion configured to bias the movable member towards the sheet stacking portion, wherein when the object having the predetermined weight or more is placed on the movable member, the movable member moves downward against a biasing force of the biasing portion.

3. The sheet stacking device according to claim 1, wherein the sheet stacking portion moving downward with an increase in the amount of stacked sheets presses an object having a weight lighter than the predetermined weight placed on the movable member so as to move the movable member downward.

4. The sheet stacking device according to claim 1, further comprising a driving portion configured to lift and lower the sheet stacking portion, wherein the ejection of the sheet to the sheet stacking portion is stopped and the driving portion lifts the sheet stacking portion based on the signal output from the detecting portion in accordance with the downward movement of the movable member.

5. The sheet stacking device according to claim 4, wherein after the ejection of the sheet to the sheet stacking portion is stopped and the driving portion lifts the sheet stacking portion based on the signal from the detecting portion, the driving portion lowers the sheet stacking portion before start of the ejection of the sheet to the sheet stacking portion.

6. The sheet stacking device according to claim 1, further comprising a notifying unit configured to notify that an object is placed in a space below the sheet stacking portion based on the signal output from the detecting portion in accordance with the downward movement of the movable member.

7. The sheet stacking device according to claim 4, further comprising a sheet detecting unit configured to detect the presence or absence of the sheet stacked on the sheet stacking portion, wherein after the ejection of the sheet to the sheet stacking portion is stopped based on the signal output from the detecting portion in accordance with the downward movement of the movable member and the sheet detecting unit detects that the sheet stacked on the sheet stacking portion is removed, the driving portion lifts the sheet stacking portion.

8. The sheet stacking device according to claim 7, further comprising a top-surface-position detecting unit configured to detect a top surface of the sheet stacking portion or a top-surface position of the sheet stacked on the sheet stacking portion, wherein after the sheet detecting unit detects that the sheet stacked on the sheet stacking portion is removed, the driving portion lifts the sheet stacking portion until the top-surface-position detecting unit detects the top surface of the sheet stacking portion.

9. An image forming apparatus comprising:

an image forming portion configured to form an image on a sheet; and the sheet stacking portion according to claim 1, wherein the sheet having the image formed thereon by the image forming portion is ejected so as to be stacked onto the sheet stacking portion.

10. A sheet stacking device including a liftable/lowerable sheet stacking portion on which sheets to be ejected are stackable, the sheet stacking portion being movable downward as an amount of stacked sheets increases, the sheet stacking device comprising:

a movable member disposed below the sheet stacking portion with a space therebetween; and a detecting portion configured to output a signal in accordance with a position of the movable member, wherein lowering of the sheet stacking portion is restricted based on the signal output from the detecting portion in accordance with downward movement of the movable member.

11. The sheet stacking device according to claim 10, further comprising a biasing portion configured to bias the movable member towards the sheet stacking portion, wherein when an object having a predetermined weight or more is placed on the movable member, the movable member moves downward against a biasing force of the biasing portion, and wherein lowering of the sheet stacking portion is restricted based on the signal output from the detecting portion in accordance with the downward movement of the movable member.

12. The sheet stacking device according to claim 10, wherein the sheet stacking portion moving downward with an increase in the amount of stacked sheets presses an object placed on the movable member so as to move the movable member downward.

13. The sheet stacking device according to claim 12, further comprising a driving portion configured to lift and lower the sheet stacking portion, wherein the ejection of the sheet to the sheet stacking portion is stopped and the driving portion lifts the sheet stacking portion based on the signal output from the detecting portion in accordance with the downward movement of the movable member.

14. The sheet stacking device according to claim 13, wherein after the ejection of the sheet to the sheet stacking portion is stopped and the driving portion lifts the sheet stacking portion based on the signal from the detecting portion, the driving portion lowers the sheet stacking portion before start of the ejection of the sheet to the sheet stacking portion.

15. The sheet stacking device according to claim 10, further comprising a notifying unit configured to notify that an object is placed in a space below the sheet stacking portion based on the signal output from the detecting portion in accordance with the downward movement of the movable member.

16. The sheet stacking device according to claim 13, further comprising a sheet detecting unit configured to detect the presence or absence of the sheet stacked on the sheet stacking portion, wherein after the ejection of the sheet to the sheet stacking portion is stopped based on the signal output from the detecting portion in accordance with the downward movement of the movable member and the sheet detecting unit detects that the sheet stacked on the sheet stacking portion is removed, the driving portion lifts the sheet stacking portion.

17. The sheet stacking device according to claim 16, further comprising a top-surface-position detecting unit configured to detect a top surface of the sheet stacking portion or a top-surface position of the sheet stacked on the sheet stacking portion, wherein after the sheet detecting unit detects that the sheets stacked on the sheet stacking portion is removed, the driving portion lifts the sheet stacking portion until the top-surface-position detecting unit detects the top surface of the sheet stacking portion.

18. The sheet stacking device according to claim 10, wherein the ejection of the sheet to the sheet stacking portion is stopped based on the signal output from the detecting portion in accordance with downward movement of the movable member.

19. A sheet stacking device including a liftable/lowerable sheet stacking portion on which sheets to be ejected are stackable, the sheet stacking portion being movable downward as an amount of stacked sheets increases, the sheet stacking device comprising:

a movable member disposed below the sheet stacking portion with a space therebetween; and a detecting portion configured to output a signal in accordance with a position of the movable member, wherein the sheet stacking portion moving downward with an increase in the amount of stacked sheets presses an object placed on the movable member so as to move the movable member downward, and wherein ejection of the sheet to the sheet stacking portion is stopped based on the signal output from the detecting portion in accordance with the downward movement of the movable member.

20. The sheet stacking device according to claim 19, further comprising a biasing portion configured to bias the movable member towards the sheet stacking portion, wherein when an object having a predetermined weight or more is placed on the movable member, the movable member moves downward against a biasing force of the biasing portion.

21. The sheet stacking device according to claim 19, further comprising a driving portion configured to lift and lower the sheet stacking portion, wherein the ejection of the sheet to the sheet stacking portion is stopped and the driving portion lifts the sheet stacking portion based on the signal output from the detecting portion in accordance with the downward movement of the movable member.

22. The sheet stacking device according to claim 21, wherein after the ejection of the sheet to the sheet stacking portion is stopped and the driving portion lifts the sheet stacking portion based on the signal from the detecting portion, the driving portion lowers the sheet stacking portion before start of the ejection of the sheet to the sheet stacking portion.

23. The sheet stacking device according to claim 19, further comprising a notifying unit configured to notify that an object is placed in a space below the sheet stacking portion based on the signal output from the detecting portion in accordance with the downward movement of the movable member.

24. The sheet stacking device according to claim 21, further comprising a sheet detecting unit configured to detect the presence or absence of the sheet stacked on the sheet stacking portion, wherein after the ejection of the sheet to the sheet stacking portion is stopped based on the signal output from the detecting portion in accordance with the downward movement of the movable member and the sheet detecting unit detects that the sheet stacked on the sheet stacking portion is removed, the driving portion lifts the sheet stacking portion.

25. The sheet stacking device according to claim 24, further comprising a top-surface-position detecting unit configured to detect a top surface of the sheet stacking portion or a top-surface position of the sheet stacked on the sheet stacking portion, wherein after the sheet detecting unit detects that the sheet stacked on the sheet stacking portion is removed, the driving portion lifts the sheet stacking portion until the top-surface-position detecting unit detects the top surface of the sheet stacking portion.

26. An image forming apparatus comprising:

an image forming portion configured to form an image on a sheet; and the sheet stacking portion according to claim 19, wherein the sheet having the image formed thereon by the image forming portion is ejected so as to be stacked onto the sheet stacking portion.

* * * * *